US007093723B1

(12) United States Patent
Lyons et al.

(10) Patent No.: US 7,093,723 B1
(45) Date of Patent: Aug. 22, 2006

(54) DISPLAY SYSTEM AND ASSOCIATED METHODS

(75) Inventors: James P. Lyons, Ocoee, FL (US); Michael W. MacGeorge, Casselberry, FL (US); John Norton Reynolds, IV, Key Largo, FL (US)

(73) Assignee: AD4, LLC, Casselberry, FL (US)

( * ) Notice: Subject to any disclaimer, the term of this patent is extended or adjusted under 35 U.S.C. 154(b) by 0 days.

(21) Appl. No.: 11/049,596

(22) Filed: Feb. 2, 2005

(51) Int. Cl.
*G09F 11/12* (2006.01)
*G09F 15/00* (2006.01)

(52) U.S. Cl. ..... 211/1.56; 211/163; 40/39; 40/473; 40/493; 40/501; 40/503; 40/505; 40/624

(58) Field of Classification Search ..... 211/1.56; 40/473, 493, 501, 502, 503, 504, 505, 506, 40/475
See application file for complete search history.

(56) References Cited

U.S. PATENT DOCUMENTS 1,112,921 A * 10/1914 La Pearl ..... 40/505
1,195,369 A 8/1916 Pearl
1,362,542 A 12/1920 Rogers
1,650,059 A 11/1927 Bartolomucci
1,650,205 A 11/1927 Gower et al.
1,652,335 A 12/1927 Wiley
1,699,857 A * 1/1929 Ruegger ..... 40/479
1,785,204 A * 12/1930 Nelson et al. ..... 40/505
2,526,514 A * 10/1950 Stadtmiller ..... 40/432
2,978,821 A * 4/1961 Kaufmann, Jr. ..... 40/505
3,643,359 A * 2/1972 Nowicki ..... 40/475
3,755,936 A * 9/1973 Terre et al. ..... 40/473
3,921,321 A 11/1975 Weisskopf
4,521,983 A 6/1985 Wakatake
5,572,816 A 11/1996 Anderson, Jr. et al.

FOREIGN PATENT DOCUMENTS

FR 2699313 * 12/1992

* cited by examiner

*Primary Examiner*—Richard E. Chilcot, Jr.
*Assistant Examiner*—Jared W. Newton
(74) *Attorney, Agent, or Firm*—Mark R. Malek; The Torpy Group, P.L.

(57) ABSTRACT

A display system may include a frame, column connection members connected to the frame, and four-sided column members positioned adjacent one another and rotatably connected to the column connection members. Each column member may include a connector and elongate display members positioned adjacent one another and pivotally connected to the connector. The display system may also include a drive assembly carried by the frame that engages the column connection members to rotate each column member so that selective display members pivot in a predetermined direction during rotation to change the shape of the column members allowing rotation thereof when positioned adjacent one another.

27 Claims, 23 Drawing Sheets

DISPLAY SYSTEM AND ASSOCIATED METHODS

RELATED APPLICATIONS

This application is related to U.S. patent application Ser. No. 11/049,595, titled *Display System Having A Magnetic Drive Assembly And Associated Methods*, filed simultaneously herewith, by the inventors of the present application, the contents of which are incorporated herein by reference in its entirety.

FIELD OF THE INVENTION

The present invention relates to the field of display signs and, more particularly, to the field of rotating display signs, and related methods.

BACKGROUND OF THE INVENTION

As illustrated in FIGS. 1 and 2A–2C, rotating signs 30 are well known in the advertising industry. More particularly, rotating billboards typically include a plurality of rotating column members 32. These column members 32 typically have a triangular shape so that they may be positioned adjacent one another and simultaneously rotated without interference from one another. More particularly, the column members 32 may be moved between first, second and third positions. FIG. 2A illustrates a column member 32 positioned in a first position, according to the prior art. FIG. 2B illustrates a column member 32 being moved between the first position, as illustrated in FIG. 2A, and a second position, as illustrated in FIG. 2C. The triangular shape of the column members 32 allows for three different advertisements to be positioned on a single billboard.

U.S. Pat. No. 3,921,321 to Weisskopf discloses a sign including a plurality of rotatable column members. More specifically, the rotatable column members have a triangular shape, and each of the column members are rotated in a circular path. Accordingly, a plurality of triangularly shaped column members may be positioned adjacent one another and still rotate in a circular path without interfering with one another. Each of the triangularly shaped column members are connected to a chain drive assembly. Movement of the chain drive assembly causes rotation of the triangularly shaped column members. Accordingly, up to three different signs, or advertisements, may be displayed on the sign.

Accordingly, a rotating billboard having triangularly shaped column members may advantageously allow simultaneous rotation of the column members while positioned adjacent one another. Of course, increasing the number of advertisements carried by a billboard may advantageously increase advertising revenue. Unfortunately, however, billboards having triangularly shaped column members are limited to displaying three advertisements. To increase the number of advertisements displayed on the billboard may require the use of a plurality of four-sided column members. Four-sided column members, however, positioned adjacent one another could not rotate in a circular path without substantial interference.

In an attempt to solve this problem, U.S. Pat. No. 1,650,205 to Grower et al. discloses a billboard system having a plurality of four-sided column members that are spaced-apart and separated by a structural frame member. Each of the column members have a plurality of panels, and the column members may be individually rotated. More specifically, one panel may be displaced in a predetermined direction to decrease the size of the column member so that an adjacent column member may rotate. In other words, one of the sides of the four-sided column member may be inwardly displaced to make room for an adjacent column member to rotate.

Another attempt to provide a display system having a rotatable four-sided column is disclosed in U.S. Pat. No. 1,362,542 to Rogers. Each column member includes four display members, and a pair of opposing curved guided walls for aligning the display members on each column member as they are rotated to a display position. The curved guide walls also act to initially pivot each display member approximately 60 degrees to allow the column member to rotate from a first display position to a second display position. This type of display system, however, is limited to displaying only two different displays.

Yet another attempt to provide a display system having a plurality of four-sided column members is disclosed in U.S. Pat. No. 1,112,921 to La Pearl. The four-sided column members in the La Pearl '921 patent are spaced-apart to facilitate rotation along a substantially circular path without interference with one another. More specifically, the sign includes a plurality of leafs to fill in the spaces between the rotating column members to provide the appearance of a continuous front display face.

There exist several different types of drive assemblies to rotate column members of a display system. For example, the Weisskopf '321 patent, discussed above, discloses a chain drive assembly to rotate column members. U.S. Pat. No. 5,572,816 to Anderson, Jr. et al. discloses a rotating sign having a cylindrical shape and a plurality of elongate louvers that rotate as the sign rotates. Rotation of each of the louvers may be accomplished using a chain drive assembly.

Another type of drive assembly for rotating an object is disclosed in U.S. Pat. No. 4,521,983 to Wakatake. More specifically, the drive assembly is a magnetic motor mechanism to rotate a sign 90 and/or 180-degrees. The magnetic motor includes four poles having an arcuate shape to allow for 90 and/or 180-degree rotation of the object.

SUMMARY OF THE INVENTION

In view of the foregoing background, it is therefore an object of the present invention to provide a display system that provides enhanced generation of display revenues.

It is also an object of the present invention to increase the number of signs that may be displayed on a display system.

It is further an object of the present invention to provide a display system having a plurality of four-sided rotatable column members that may rotate adjacent one another.

These and other objects, features, and advantages in accordance with the present invention are provided by a display system that may comprise a frame, column connection members carried by the frame, and four-sided column members rotatably connected to the column connection members. More specifically, the four-sided column members may be positioned adjacent one another and may comprise a connector, and a plurality of elongate display members positioned adjacent one another and pivotally connected to the connector.

The display system may also include a drive assembly carried by the frame. The drive assembly may engage each column connection member to rotate each column member so that selective display members pivot in a predetermined direction during rotation. Accordingly, the shape of the column members may be changed to allow rotation thereof when positioned adjacent one another. This advantageously allows the plurality of column members to selectively and simultaneously rotate. More specifically, this advantageously allows for all sides of the four-sided column members to be selectively displayed.

The column members may rotate between first, second, third and fourth positions. The first, second, third and fourth positions may be spaced 90 degrees apart.

Each connector may comprise a display guide, a display engagement member overlying the display guide, and a plurality of pin members for connecting each display member to the display engagement member. The pin members may also engage the display engagement member with the display guide.

In one embodiment of the invention, the display guide may have an hourglass shape defined by convex front and rear portions and concave side portions. In this embodiment, the display members may comprise pairs of opposing display members. A first one of the pairs of display members may pivot inwardly adjacent any one of the concave side portions of the display guide as the column members rotate.

In another embodiment of the invention, the display guide may have a star shape defined by concave front, rear and side portions. In this embodiment, the display members may pivot inwardly when adjacent the concave front, rear and side portions as the column members rotate.

The display engagement member may comprise a first display engagement member positioned adjacent a bottom portion of each column connection member. The display system may also comprise a second display engagement member that engages a top portion of each column connection member. The second display engagement member may advantageously provide additional stability of the column members when connected to the frame.

In some embodiments of the display system, the display guide may be a track. In such an embodiment, a pin member may engage the track to pivot the display members in the predetermined direction.

In other embodiments of the display system, the display guide may be a slot formed in a display guide base. In such an embodiment, a pin member may engage the slot to pivot the display members in the predetermined direction.

The drive assembly may be a chain drive assembly including a chain and a motor carried by the frame. The chain drive assembly may also include a first chain engaging member connected to the motor for engaging a portion of the chain, and a second chain engaging member spaced-apart from the first chain engaging member for engaging another portion of the chain. The chain drive assembly may also include a drive assembly connection member connected to each column connection member to engage the chain so that each column member may rotate responsive to movement of the chain.

Each of the plurality of display members may comprise a base, a first side and a second side positioned adjacent the first side. The first and second sides of each display member may be substantially flat and positioned normal to one another.

A method aspect of the present invention is for displaying indicia. The method may include positioning the indicia on a plurality of display members carried by each four-sided column member. The indicia may be positioned on the first and second sides of each display member so that the indicia may be displayed on each of the four-sides of the column members.

The method may also include rotating the column members so that the indicia on each of the four-sides of the column members may be selectively displayed. Rotating the column members may comprise pivoting each display member in a predetermined direction to change the shape of the column members. Changing the shape of the column members advantageously allows rotation of the column members when positioned adjacent one another.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and multiple prime notation is used to indicate similar elements in alternate embodiments.

Referring initially to FIGS. 3 and 4A–4C, a display system 40 in accordance with the present invention is now described in detail. The display system 40 includes a frame 42, a plurality of column connection members 44 that are connected to the frame, and a plurality of four-sided column members 46 that are positioned adjacent one another and rotatably connected to the respective column connection members.

Figure 1:
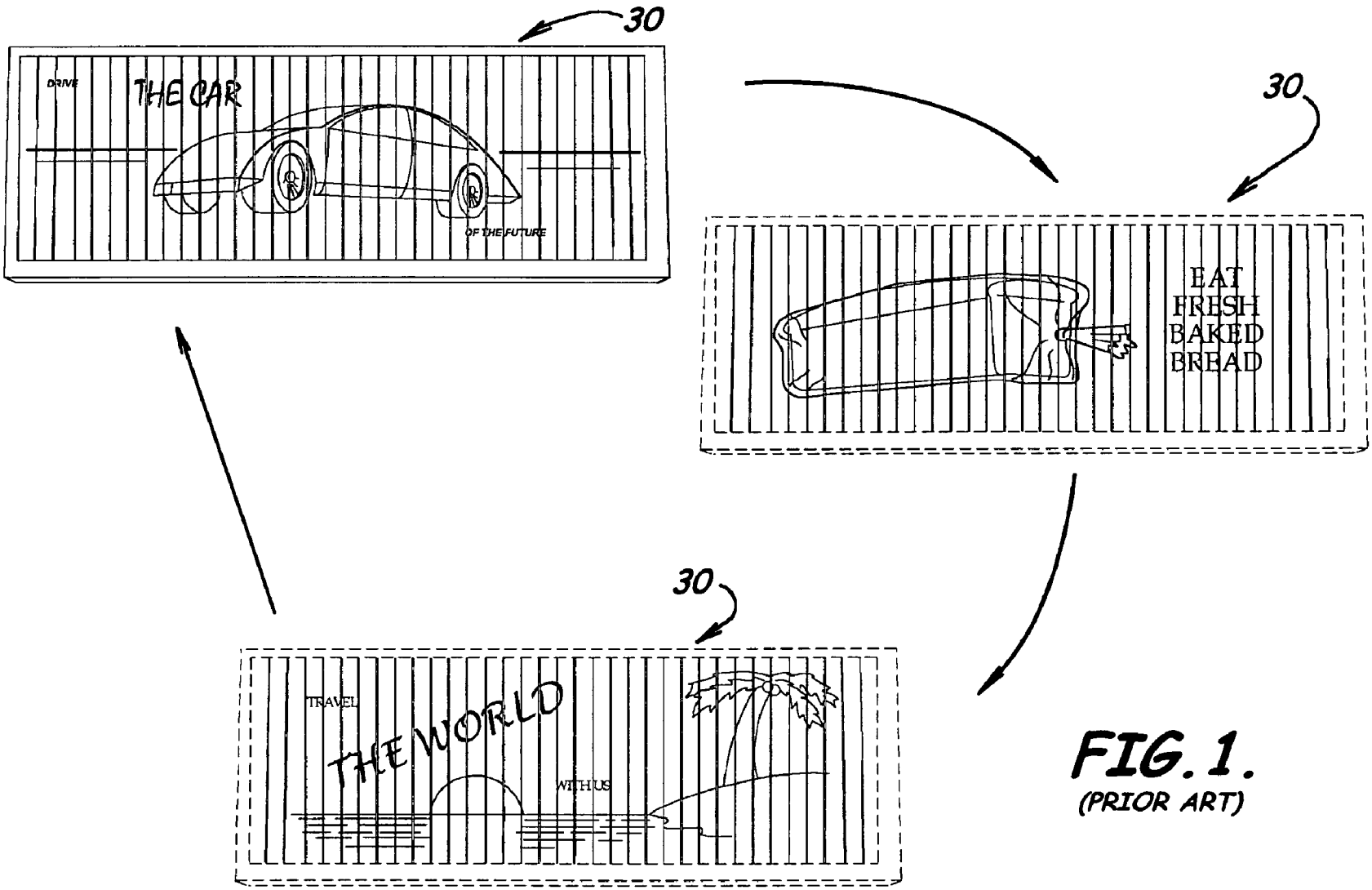
FIG. 1. (PRIOR ART)
FIG. 1 is a front perspective view of a display system according to the prior art.
Figure 2A:
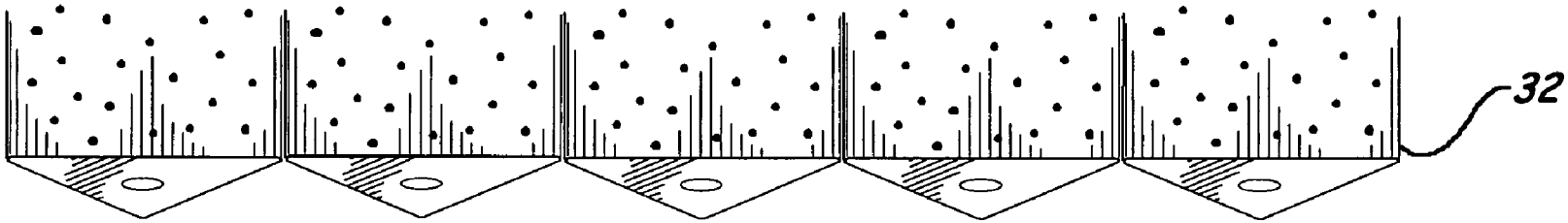
FIG. 2A. (PRIOR ART)
FIGS. 2A–2C are partial perspective views of column members of the display system illustrated in FIG. 1 according to the prior art.
Figure 2B:
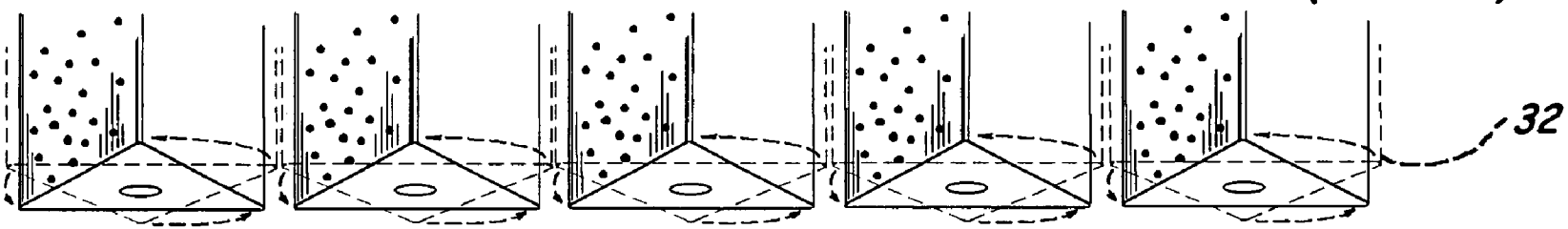
FIG. 2B. (PRIOR ART)
Figure 2C:
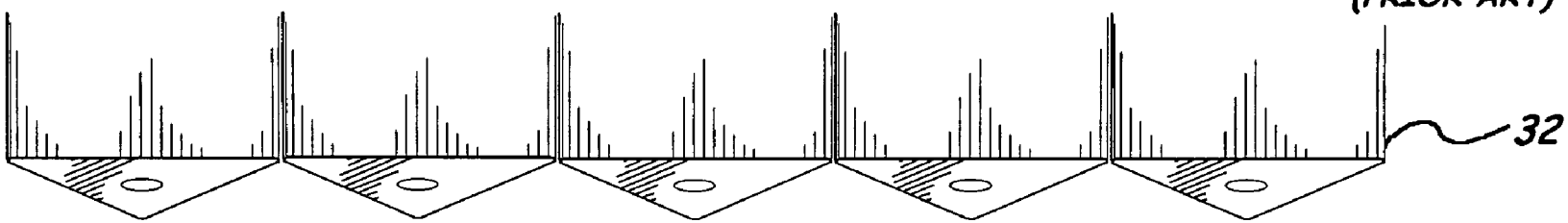
FIG. 2C. (PRIOR ART)
Figure 3:
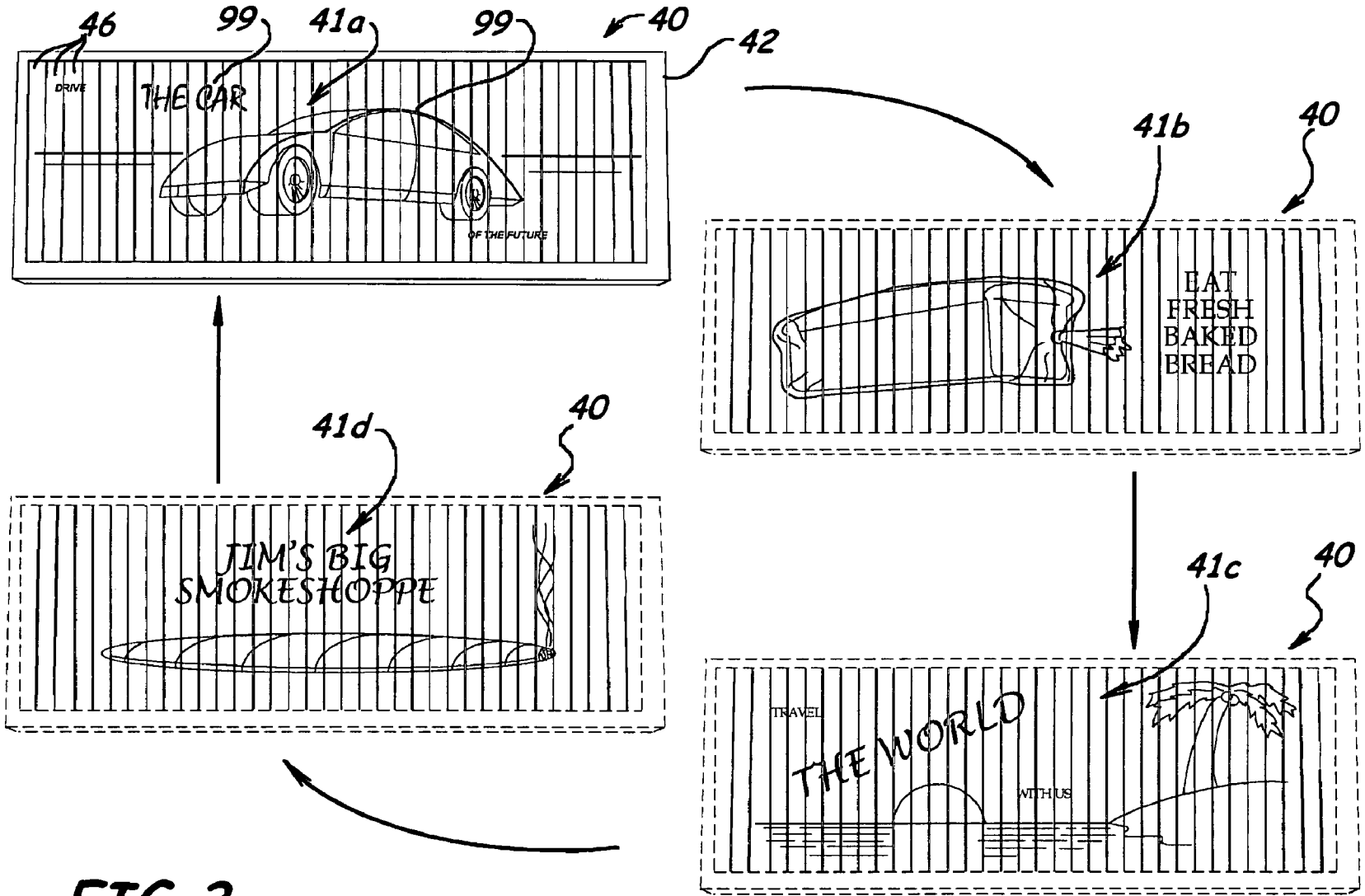
FIG. 3 is a front perspective view of a display system according to the present invention.

Accordingly, and as perhaps best illustrated in FIG. 3, the display system 40 of the present invention advantageously allows enhanced display of multiple signs 41*a*, 41*b*, 41*c*, 41*d*. More specifically, the display system 40 of the present invention advantageously allows four signs 41, which may include advertising indicia 99, for example, to be individually displayed based on rotation of the four-sided column members 46. Enhanced display of advertising indicia 99 on the multiple signs 41 carried by the display system 40 of the present invention advantageously enhances revenue that may be generated from displaying the signs.

Figure 5:
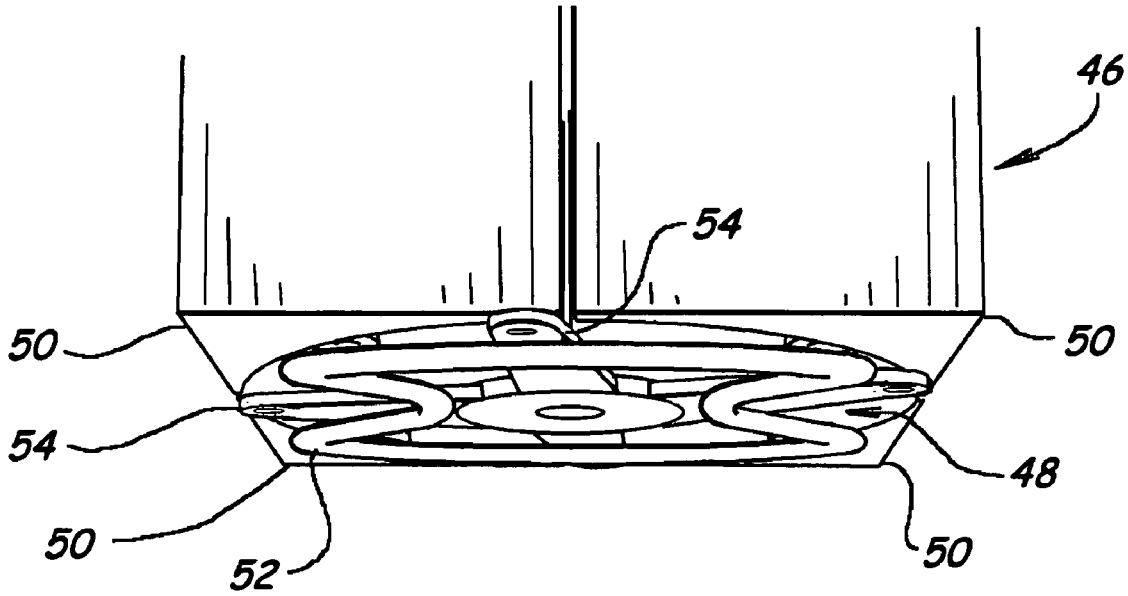
FIG. 5 is a partial perspective view of one of the column members illustrated in FIG. 4 showing a display engagement member and a display guide.
Figure 6:
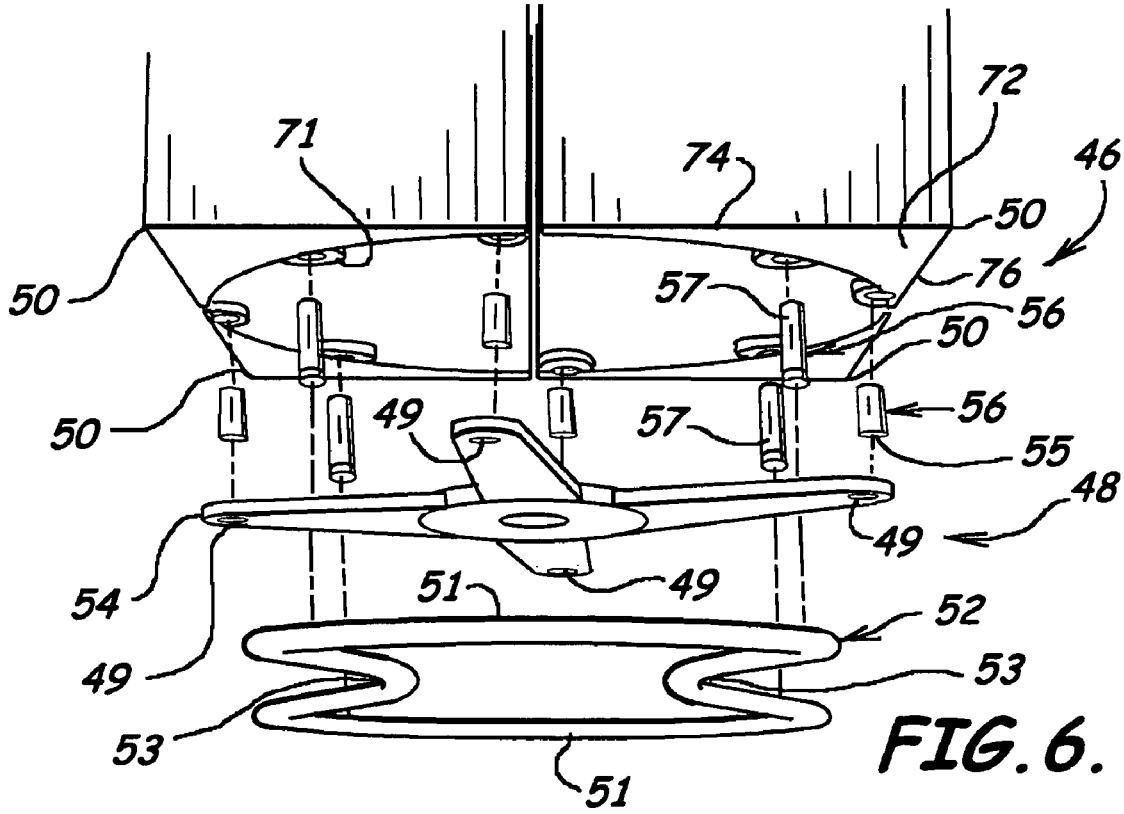
FIG. 6 is an exploded partial perspective view of the column member illustrated in FIG. 5.

Referring now additionally to FIGS. 5 and 6, the column members 46 are now described in detail. Each column member 46 may include a connector 48. The column members 46 may also include elongate display members 50 positioned adjacent one another and pivotally connected to the connector 48.

The connector 48 may illustratively include a display guide 52, a display engagement member 54, and a plurality of pin members 56 for connecting the display members to the display engagement member. The pin members 56 may also engage the display engagement member 54 with the display guide 52.

Figures 4A, 4B, 4C:
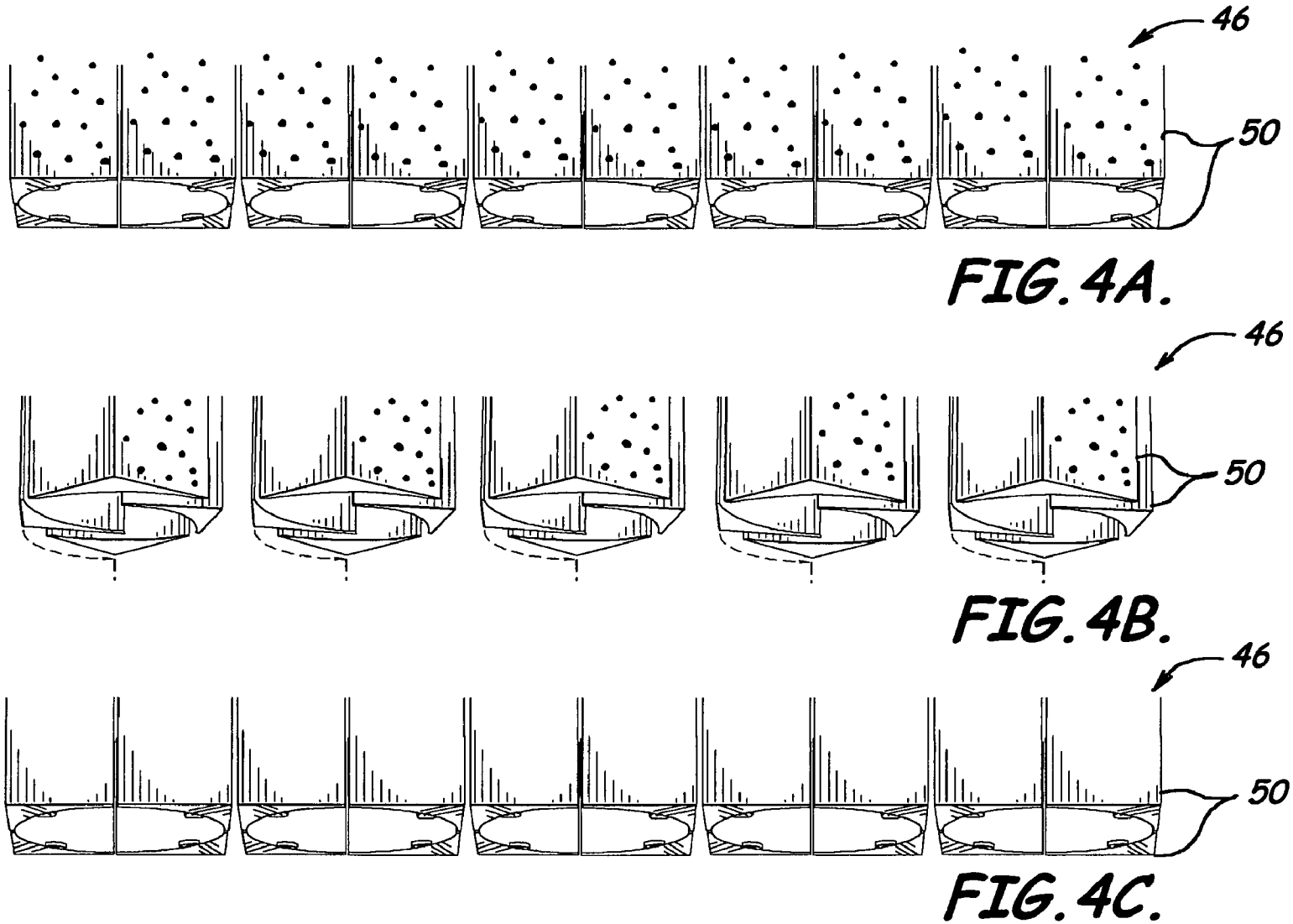
FIGS. 4A–4C are partial perspective views of four-sided column members of the display system illustrated in FIG. 3.

As perhaps best illustrated in FIGS. 4A–4C, the display members 50 may be pivoted in predetermined directions to rotate the column members 46. As will be discussed in greater detail below, the pivoting of the display members 50 changes the shape of the column members 46 to allow rotation of a plurality of four-sided column members positioned adjacent one another. More specifically, the column members 46 may be rotated between first, second, third and fourth positions.

In FIG. 4A, the column members 46 are positioned in a first position. FIG. 4B illustrates the column members 46 being rotated between the first position, illustrated in FIG. 4A, and the second position, illustrated in FIG. 4C. The display members 50 are pivoted in a predetermined direction in FIG. 4B to rotate the plurality of column members 46 when positioned adjacent one another. Although a plurality of column members 46 are illustrated in FIGS. 4A–4C, numbers are used to refer to elements of only one column member for simplicity.

Figure 16:
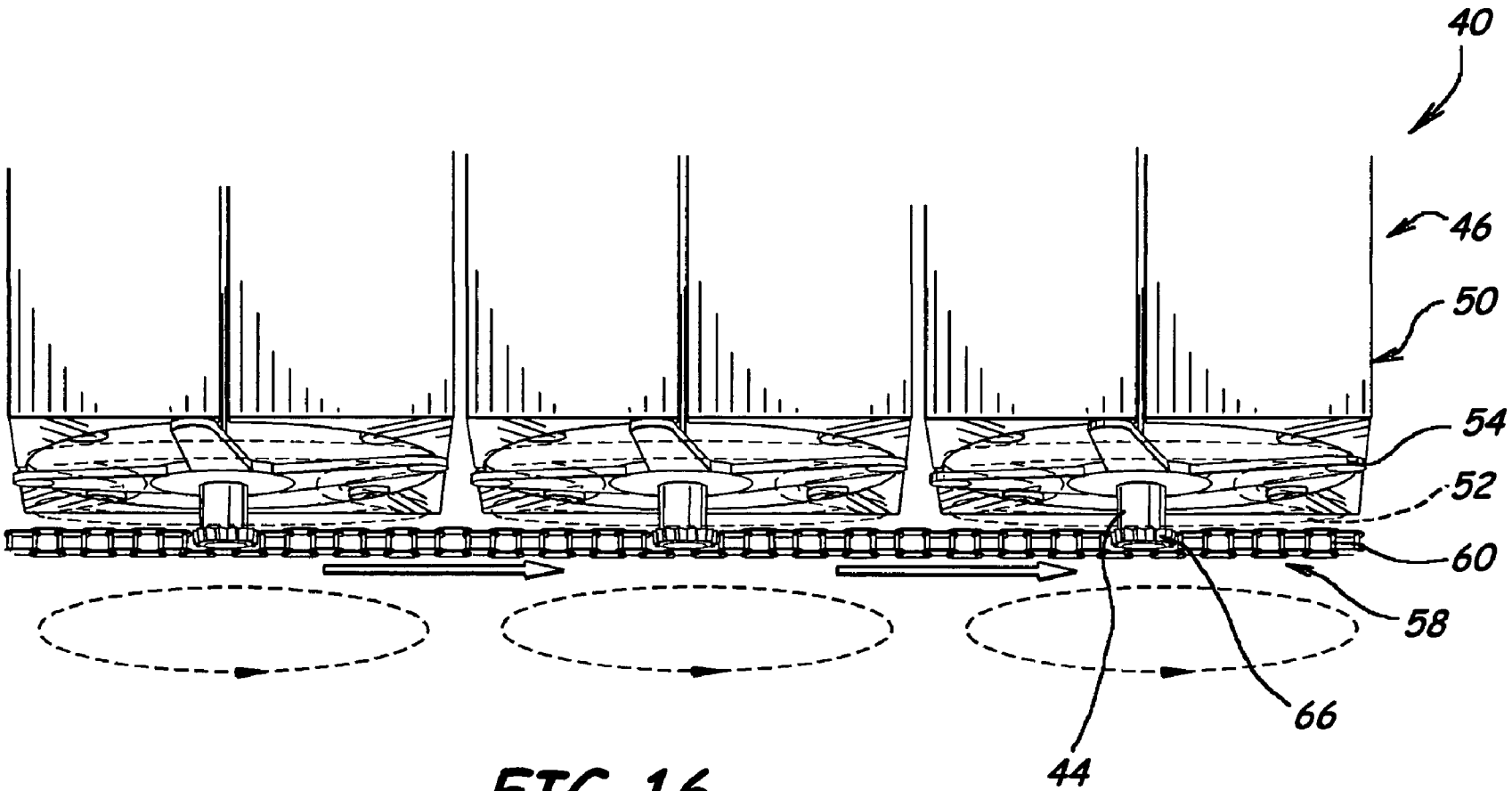
FIG. 16 is a partial perspective view of a plurality of column members positioned adjacent one another and engaging a drive assembly according to the present invention.
Figure 17:
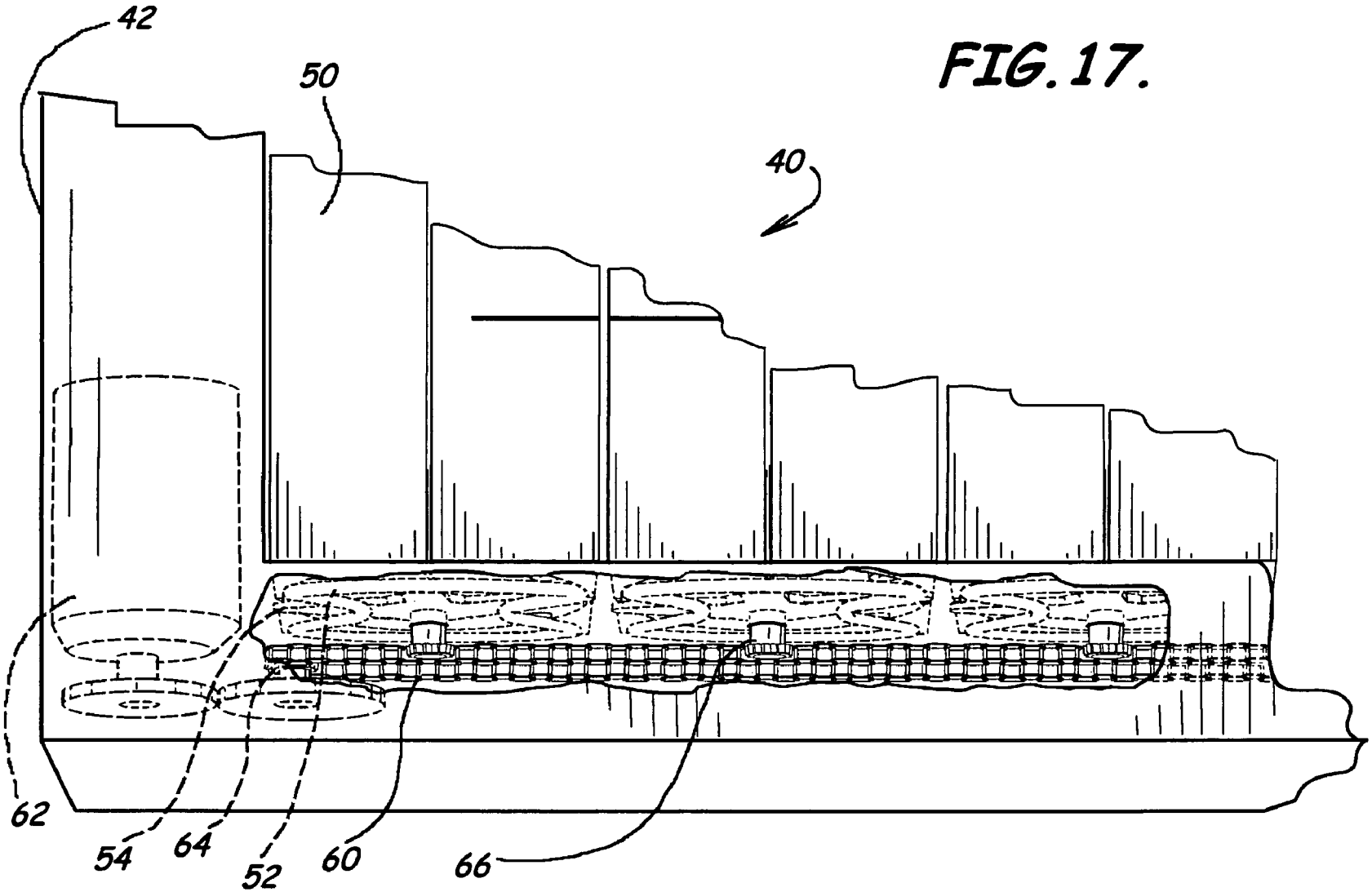
FIG. 17 is a partial perspective view of the column members illustrated in FIG. 16 connected to the drive assembly and carried by the frame.

As illustrated in FIGS. 16 and 17, the display system 40 may also include a drive assembly 58 carried by the frame 42. The drive assembly 58 may engage the column connection members 44 to rotate each column member 46. More specifically, the drive assembly 58 may engage the column connection members 44 so that selected display members 50 may pivot in the predetermined direction, as illustrated in FIGS. 4A–4C, responsive to operation of the drive assembly during rotation of the column members 46 to change the shape of the column members.

The drive assembly 58 illustrated in FIGS. 16 and 17 may be a chain drive assembly. The chain drive assembly 58 may include a chain 60 and a motor 62 carried by the frame 42. The chain drive assembly 58 may also include a first chain engaging member 64 connected to the motor 62 for engaging a portion of the chain 60. The first chain engaging member 64 and the second chain engaging member (not shown) may, for example, be provided by a gear, sprocket, or any other similar member suitable for engaging the chain 60, as understood by those skilled in the art.

The chain drive assembly 58 may also include a second chain engaging member that is spaced-apart from the first chain engaging member 64 for engaging another portion of the chain 60. The chain drive assembly 58 may also include a drive assembly connection member 66 connected to the column connection members 44 to engage the chain 60 so that each column member 46 may rotate responsive to movement of the chain. The drive assembly connection member 66 may also be a gear or sprocket, for example, or any other similar member suitable for engaging the chain 60 to cause rotation of the column members 46. Although the drive assembly 58 is illustrated in a chain drive assembly, those skilled in the art will appreciate that the drive assembly may also be provided by a cable drive assembly, or any other type of drive assembly using a looped member that engages members on the column connection members 44 so that movement of the looped member will cause rotation of the column members 46.

Referring now back to FIGS. 5 and 6, aspects of a first embodiment of the display guide 52 and display engagement member 54 are now described in greater detail. The display guide 52 may have an hourglass shape. The hourglass shape may be defined by convex front and rear portions 51 and concave side portions 53. The display engagement member 54 may have a star shape defined by a medial portion and a plurality of arm portions extending outwardly therefrom. Passageways 49 may be formed in ends of the arm portions for receiving the pin members 56. Both the display guide 52 and the display engagement member 54 may, for example, be made of a metal material, plastic material, composite material, or any other type of material having high strength properties, as understood by those skilled in the art.

As illustrated in FIGS. 7A–7E, in this embodiment, the plurality of display members 50 may be defined by pairs of opposing display members. More specifically, a first one of the pairs of display members 68 may pivot inwardly when adjacent the concave side portions 53 of the display guide 52 as each column member 46 rotates. A second pair of the display members 70 may travel along a substantially circular path adjacent the convex front and rear portions 51 of the display guide 52 when the column members 46 rotate.

Figure 7A:
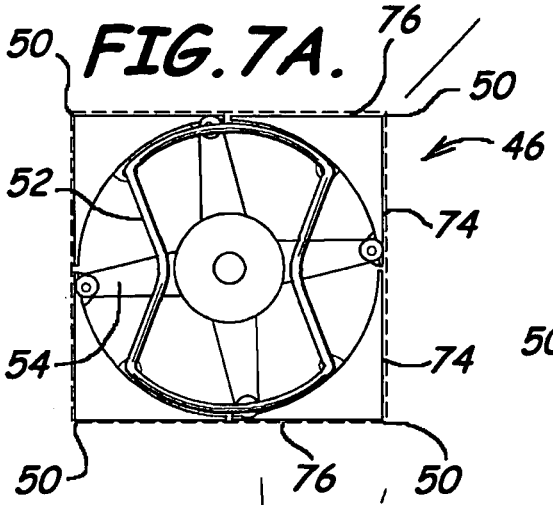
FIGS. 7A–7E are top plan views of the column members shown in FIG. 5 being rotated between first, second, third and fourth positions.
Figure 7B:
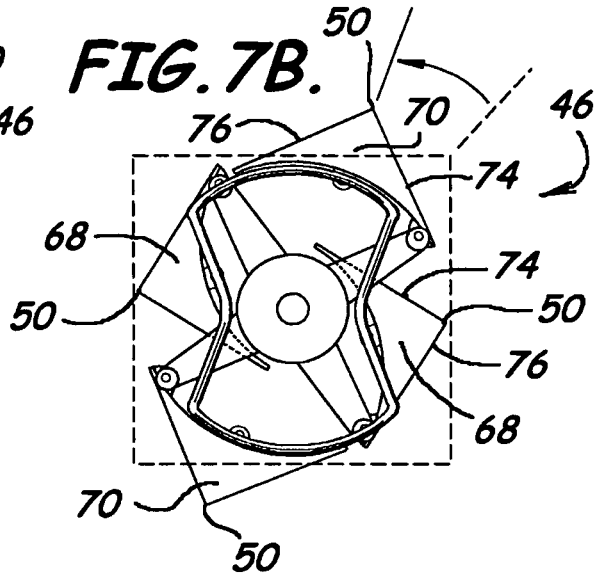
Figure 7C:
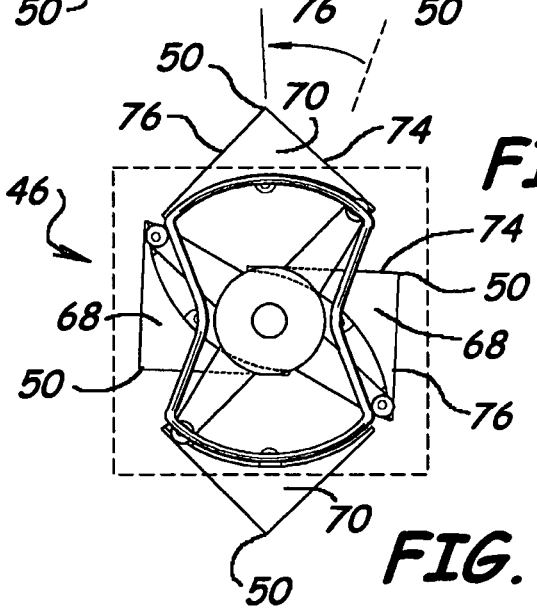
Figure 7D:
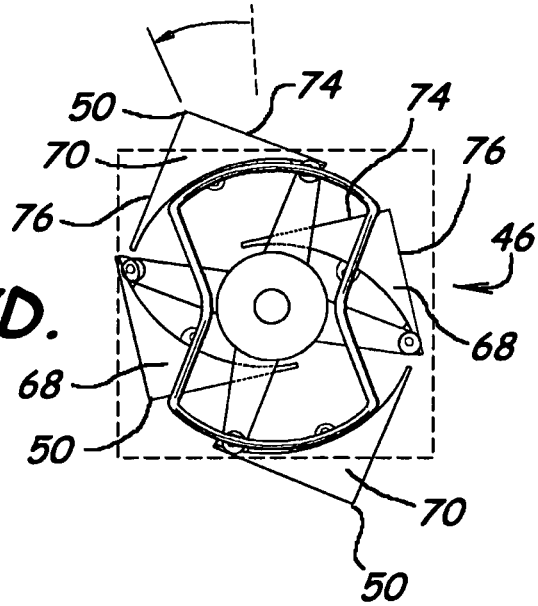
Figure 7E:
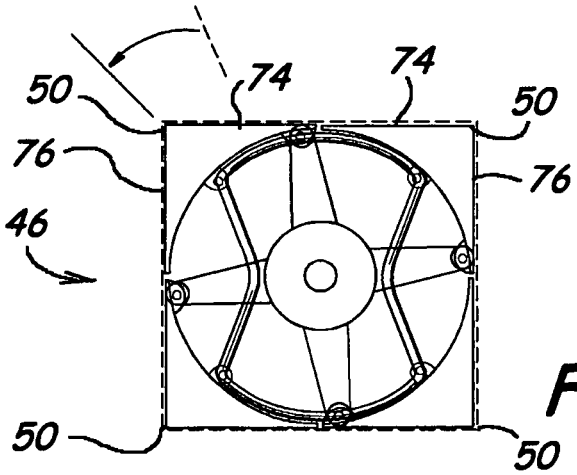

FIGS. 7A–7E illustrate rotation of a column member 46 when using the hourglass shaped display guide 52. The column member 46 illustrated in FIG. 7A is in a first position. The column member 46 illustrated in FIG. 7E is in a second position. FIGS. 7B–7D illustrate the movement of the column member 46 from the first position to the second position. More specifically, the first pair of opposing display members 68 pivot inwardly when adjacent the concave side portions 53 of the display guide 52, and the second pair of display members 70 travel along a substantially circular path adjacent the convex front and rear portions 51 of the display guide when the column member 46 rotates.

Accordingly, the shape of the column member 46 may be changed during rotation to allow a plurality of column members positioned adjacent one another to rotate simultaneously. In other words, and as illustrated in FIGS. 7A and 7E, the general shape of the column members 46 is preferably square. In order for a plurality of square shaped column members to rotate adjacent one another, the shape is changed, as illustrated in FIGS. 7B–7D, so that the column members 46 may rotate without interference from one another.

Figure 8:
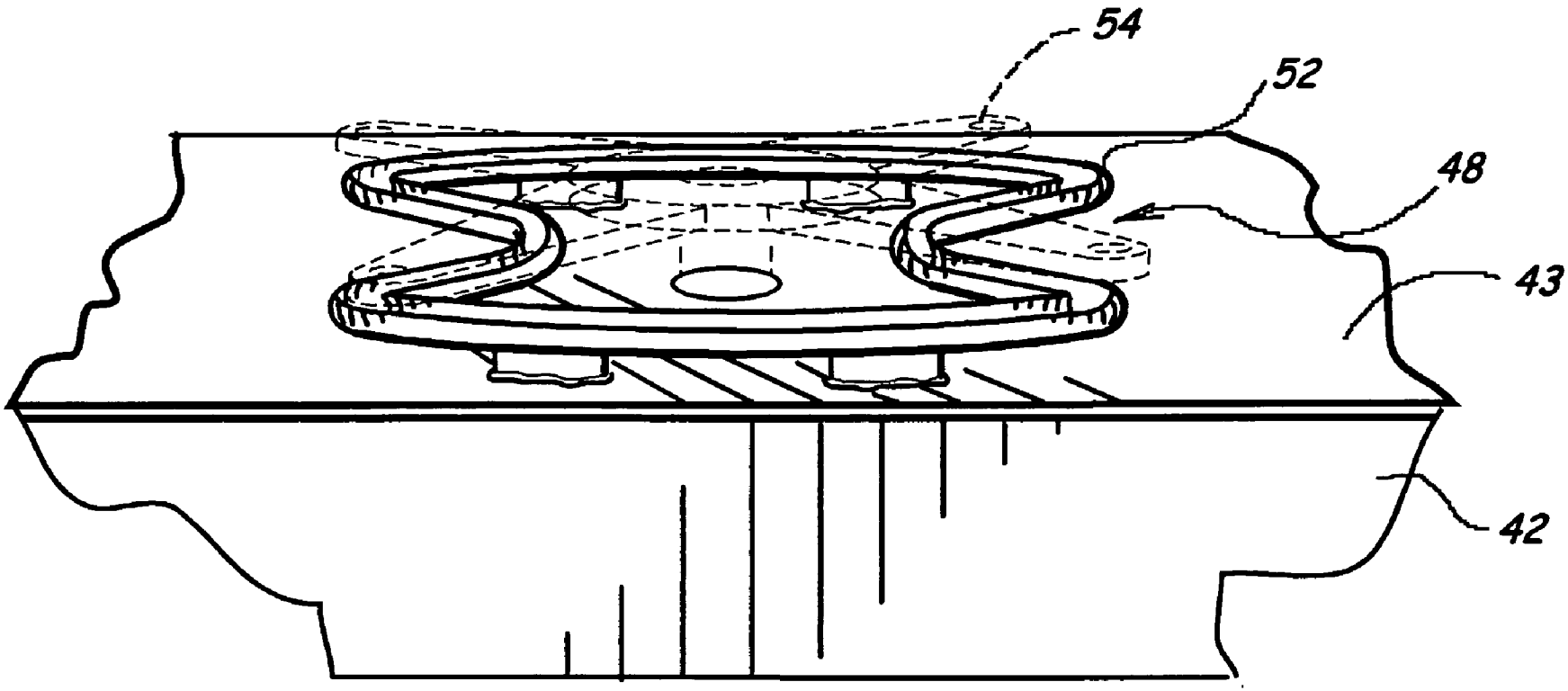
FIG. 8 is a partial perspective view of a display guide connected to a frame of the display system.

As illustrated in FIG. 8, the display guide 52 may be a track. Further, the pin members 56 may comprise track engagement pin members 57 and display engagement pin member 55. More specifically, the track engagement pin members 57 may engage the display guide track 52 to pivot the display members 50 in a predetermined direction. The display engagement pin members 55 may engage the display members 50 with the display engagement member 54 to thereby connect the display members to a display engagement member. The pin members 56 are preferably made of high strength material, such as a metal or a composite, for example, or any other type of high strength material as understood by those skilled in the art.

The display guide track 52 may be mounted to a display base 43. The display base 43 is preferably carried by the frame 42. The display guide track 52 may be connected to the display base 43 using any one of a number of different types of connections. For example, the display guide track 52 may be mounted to the display base 43 using mechanical connectors, e.g., screws. The display guide track 52 may also be mounted to the display base 43 using other connections, such as a welded connection, for example, or any other type of connection as understood by those skilled in the art. Further, those skilled in the art will appreciate that the display guide track 52 and the display base 43 may be integrally formed as a monolithic unit.

Figure 9:
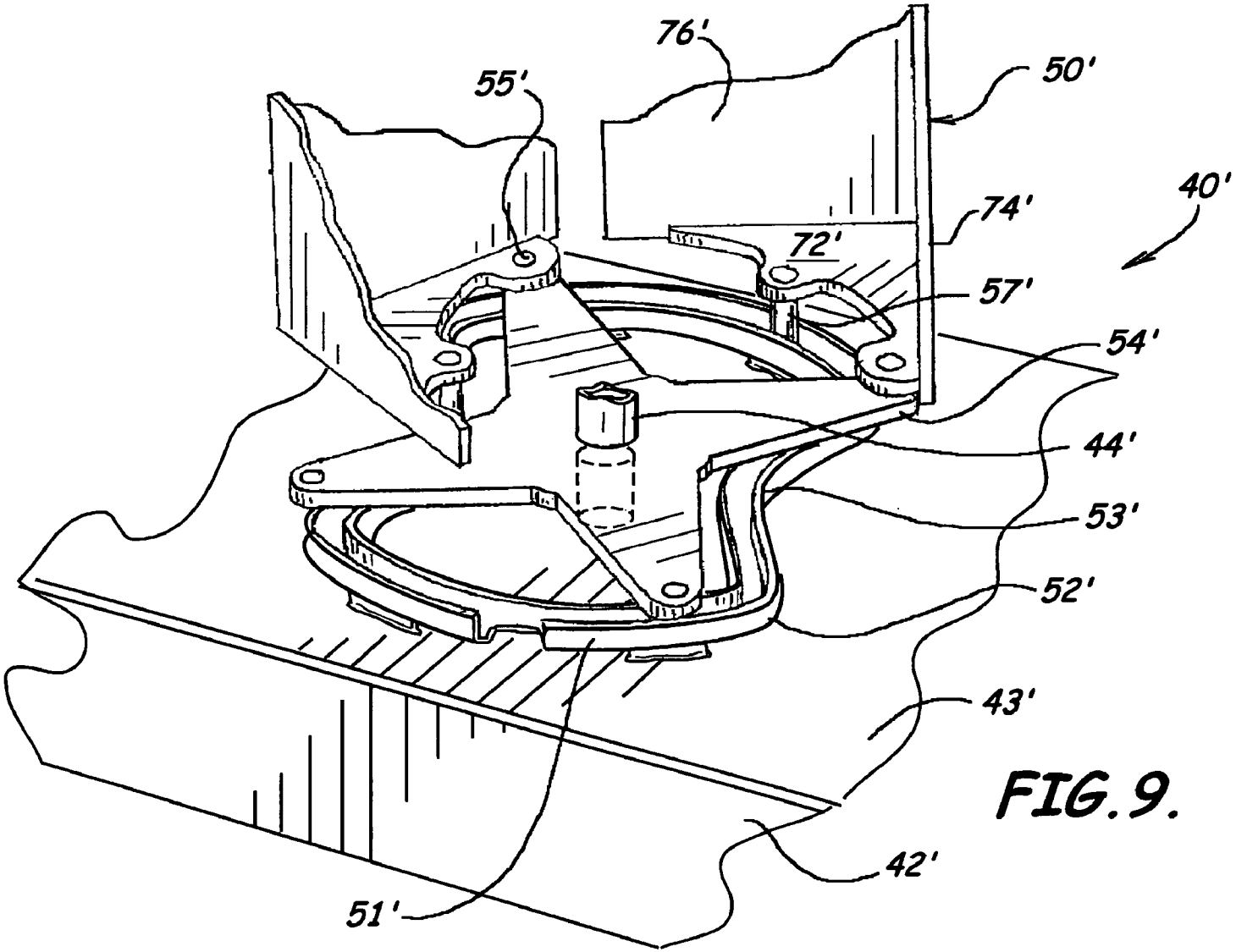
FIG. 9 is a partial perspective view of a column member connected to the display guide illustrated in FIG. 8.
Figure 10:
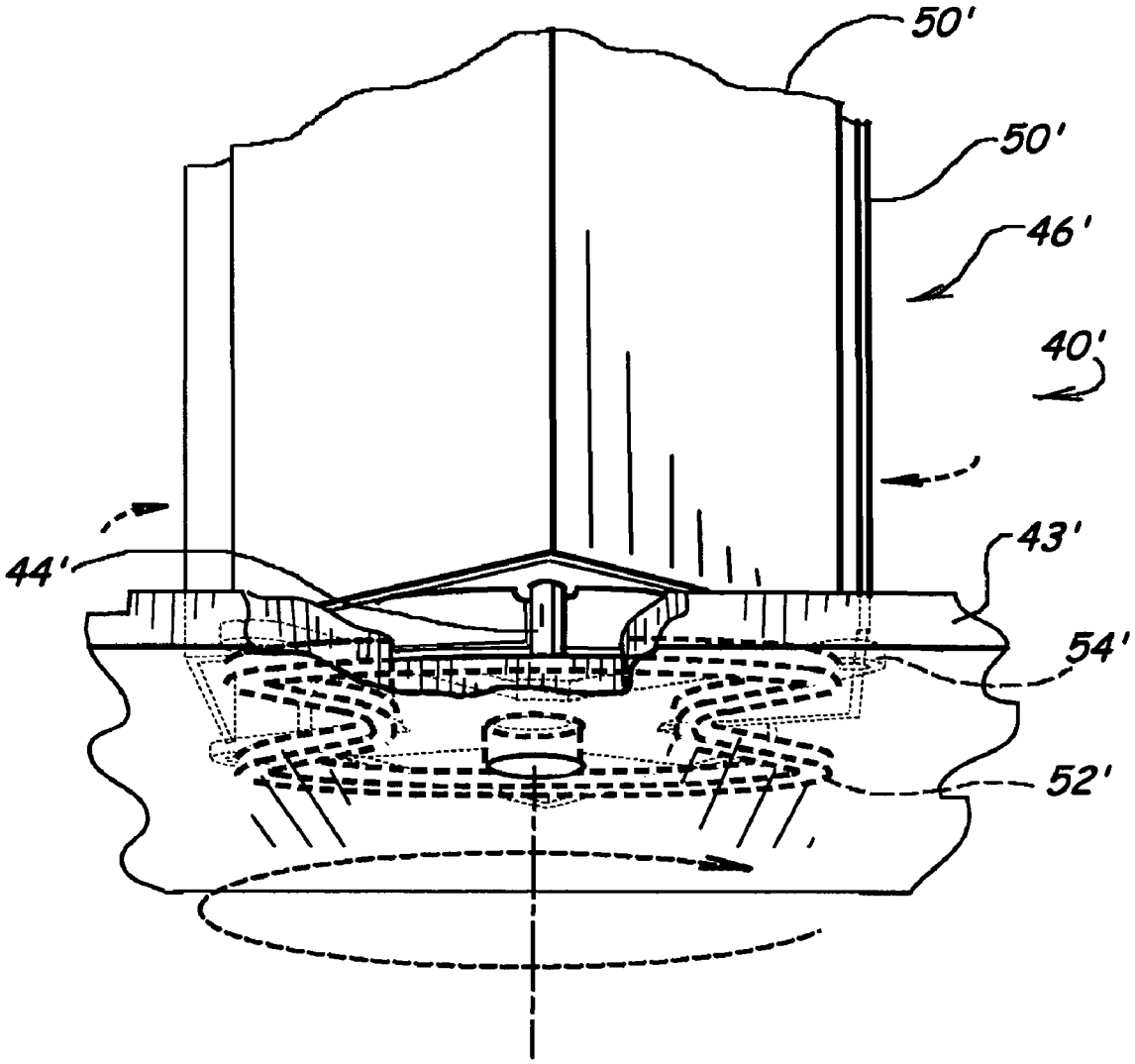
FIG. 10 is a partial perspective view of a column member connected to the display guide illustrated in FIG. 8 and being moved between any one of the first, second, third and fourth positions.

Another embodiment of the display guide track 52' is illustrated in FIGS. 9 and 10. The display guide track 52' illustrated in FIGS. 9 and 10 is mounted to the display guide base 43', and preferably has a U-shape. When using this embodiment of the display guide 52', the track engagement pin members 57' engages an interior section of the U-shaped portion of the display guide track. The display engagement pin members 55' connect the display members 50' to the display engagement member 54'. The other elements of this embodiment of the invention are similar to those of the first embodiment of the invention, are labelled with prime notation and require no further discussion herein.

Figure 12:
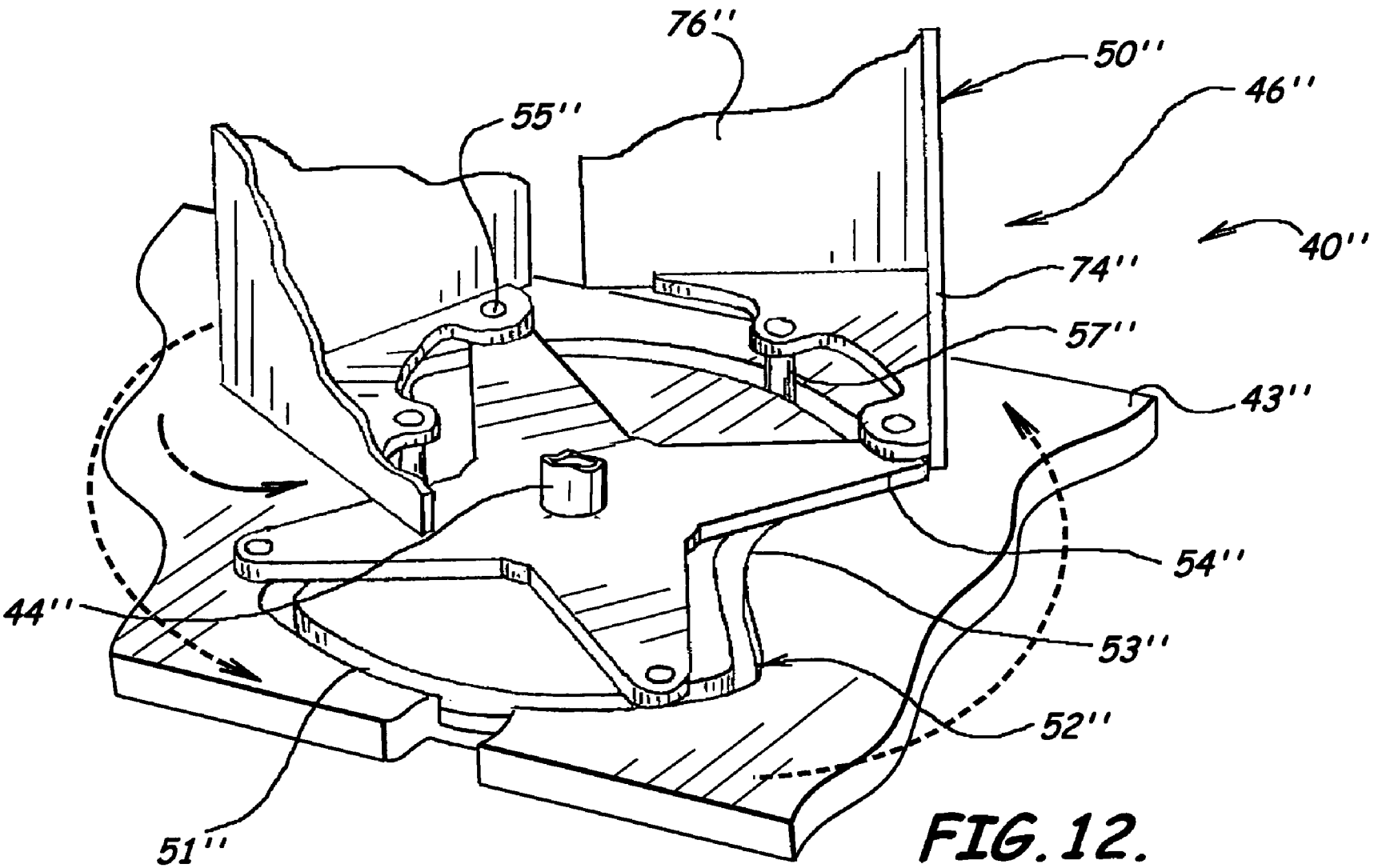
FIG. 12 is a perspective view of a column member connected to another embodiment of the display guide according to the present invention.

Referring now additionally to FIG. 12, yet another embodiment of the display guide 52" is described in greater detail. In this embodiment, the display guide 52" is provided by a slot formed in the display guide base 43". The track engagement pin members 57" engage the slot 52" to pivot the display members 50" in the predetermined direction as the column member 46" rotates. The other elements of this embodiment of the invention are similar to the elements of the first embodiment, are labelled with double prime notation, and require no further discussion herein.

Figure 11:
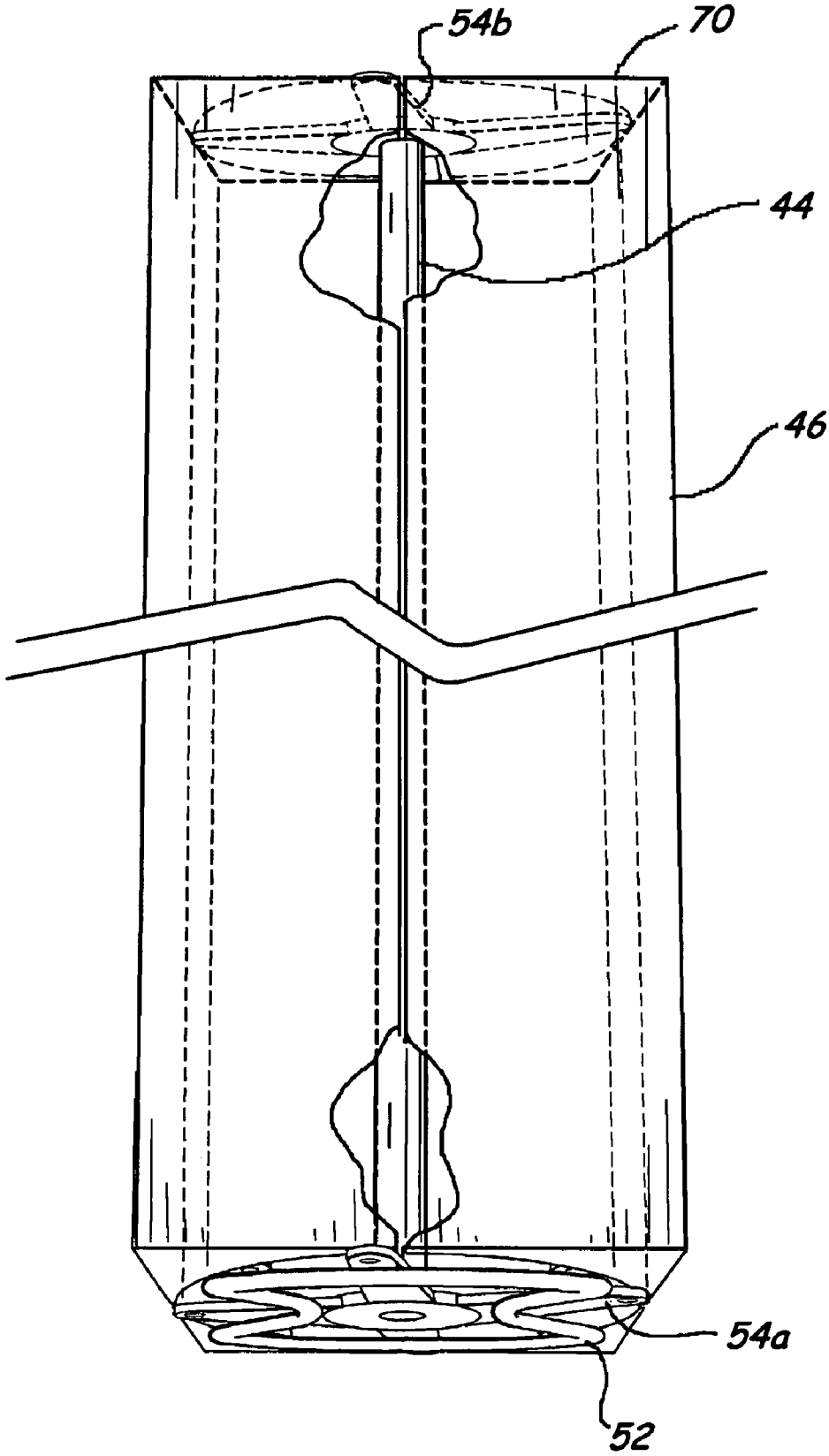
FIG. 11 is a broken partial perspective view of the column member illustrated in FIG. 5 connected to a display engagement member adjacent top and bottom portions thereof.

Referring now back to FIG. 11, another aspect of the display system 40 is now described in greater detail. The display system 40 may illustratively comprise a pair of opposing display engagement members 54*a*, 54*b*. More specifically, the first display engagement member 54*a* may be positioned adjacent a bottom portion of each column connection member 44. The second display engagement member 54*b* may engage a top portion of each column connection member 44 and may also engage a top portion of the frame 42. Accordingly, the pair of opposing display engagement members 54*a*, 54*b* may advantageously enhance stability of the column members 46 when connected to the frame 42.

The display members 50 may each comprise a base 72, a first side 74 and a second side 76 positioned adjacent the first side. The first and second sides 74, 76, of the display member 50 are preferably connected to the base 72 and extend upwardly therefrom. Further, each display member 50 may include a top 79 that overlies and connects to the first and second sides 74, 76 of the display member. The first and second sides of each display member 76, 78 are preferably substantially flat and positioned normal to one another, i.e., ends of the first and second sides of the display member meet to form a 90 degree corner.

In the attached drawings, the column members 46 are carried by the frame 42 in a vertical position. Those skilled in the art, however, will appreciate that the column members 46 may also be carried in a horizontal position by the frame 42. The column members 46 may have a length extending substantially the distance from a bottom portion of the frame 42 to a top portion of the frame. Of course, in those instances where the column members 46 are positioned in a horizontal configuration, the length of the column members may extend substantially the length between side portions of the frame 42.

In a typical use of the display system 40 as a roadside billboard, the first and second sides 74, 76 of the display members 50 preferably have a width of about 1.5 to 6 inches. Accordingly, when the display members 50 are positioned adjacent one another, a column member 46 may have a width between about 3 to 12 inches. Of course, since the display system 40 of the present invention may be used for displaying any type of sign 41, the size of the display members 50 may be any suitable size for displaying the desired sign.

As perhaps best illustrated in FIG. 6, the base 72 of the display members 50 may have a plurality of pin receiving passageways 71 formed therein. Accordingly, the pin members 56 may engage the pin receiving passageways 71 to connect the display members 50 to the display engagement member 54 and the display guide 52.

Figure 13:
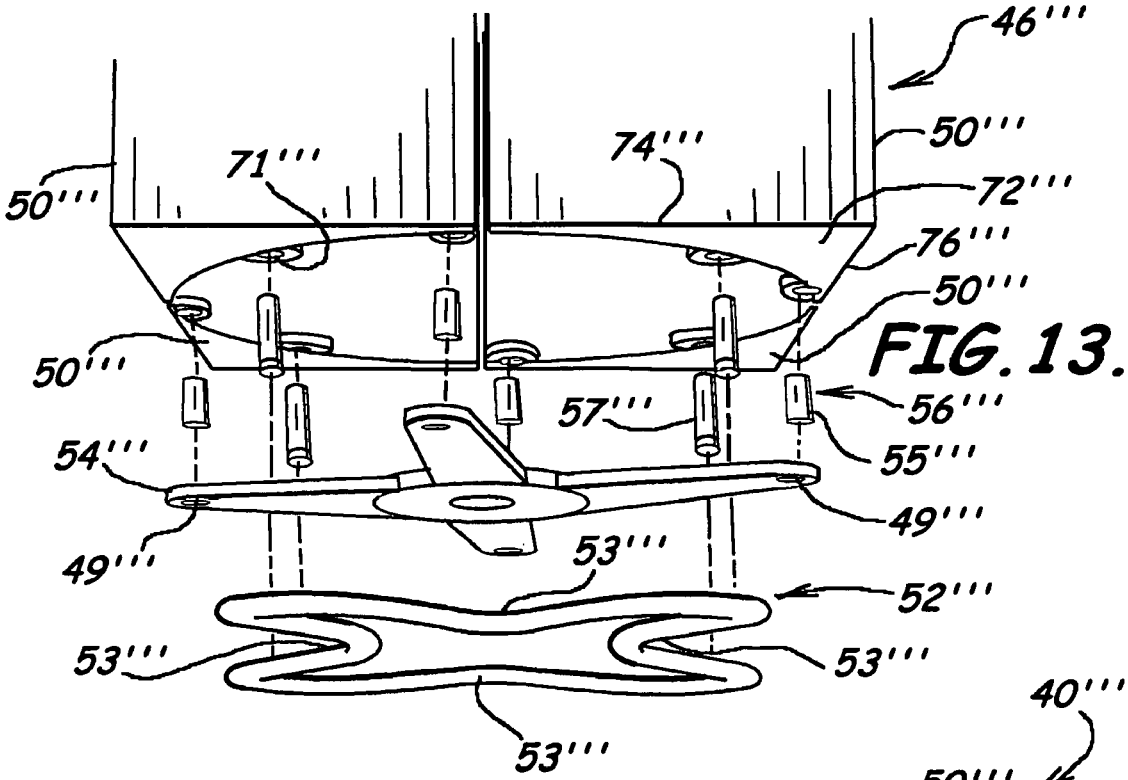
FIG. 13 is an exploded partial perspective view of a column member connected to another embodiment of the display guide according to the present invention.
Figure 14:
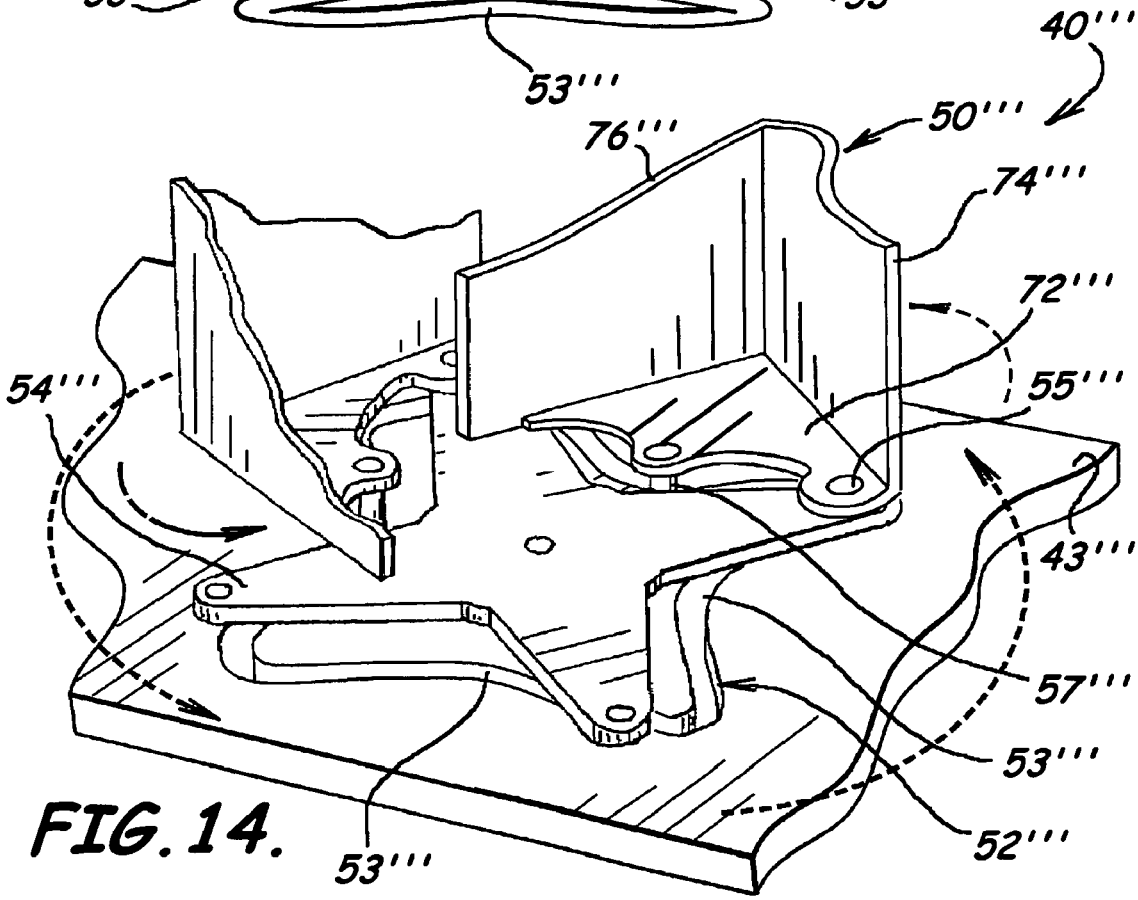
FIG. 14 is a partial perspective view of a column member connected to still another embodiment of a display guide according to the present invention.

Referring now additionally to FIGS. 13 and 15A–15E, still another embodiment of the display guide 52'" is now described. As illustrated in FIG. 13, the display guide 52''' may have a star shape defined by concave front, rear and side portions 53'''. As perhaps best illustrated in FIGS. 15A–15E, the display members 50''' may pivot inwardly when adjacent the concave front, rear and side portions 53''' as the column member 46''' rotates.

Similar to the embodiment of the display guide 52''' having an hourglass shape, the embodiment of the display guide having a star shape may also be provide by a display guide track, or a display guide slot formed in the display guide base 43'''. With respect to the display guide track 52''', the plurality of pin members 56''' may include track engagement pin members 57''' that engage each of the display members 50''' to the display guide. The plurality of pin members 56''' may also include a plurality of display engagement pin members 55''' for engaging the display members 50''' to the display engagement member 54'''.

Figure 15A:
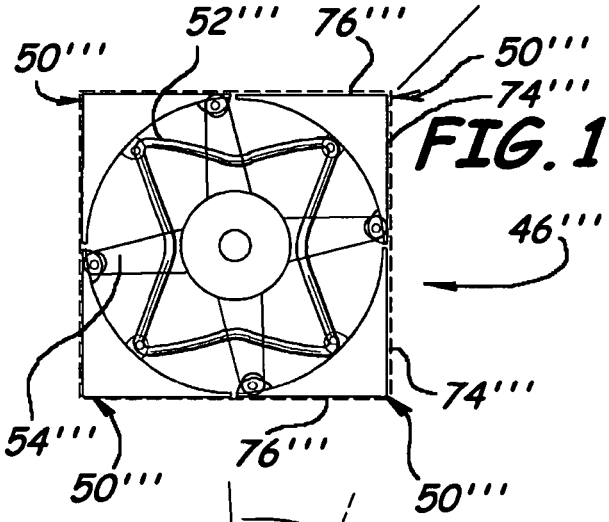
FIGS. 15A–15E are top plan views of the column member shown in FIG. 13 being moved between first, second, third and fourth positions.
Figure 15B:
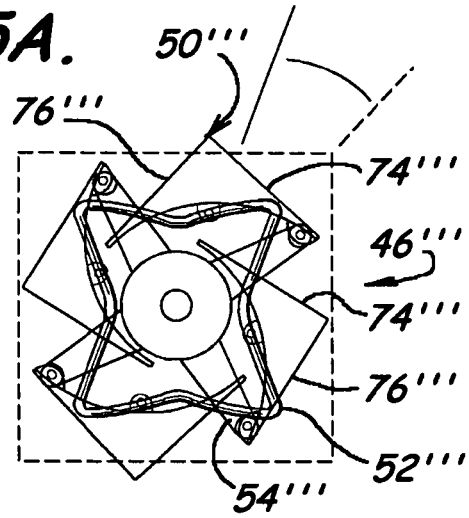
Figure 15C:
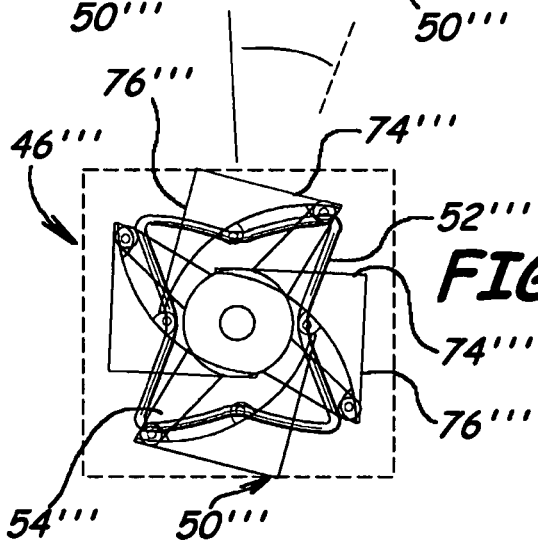
Figure 15D:
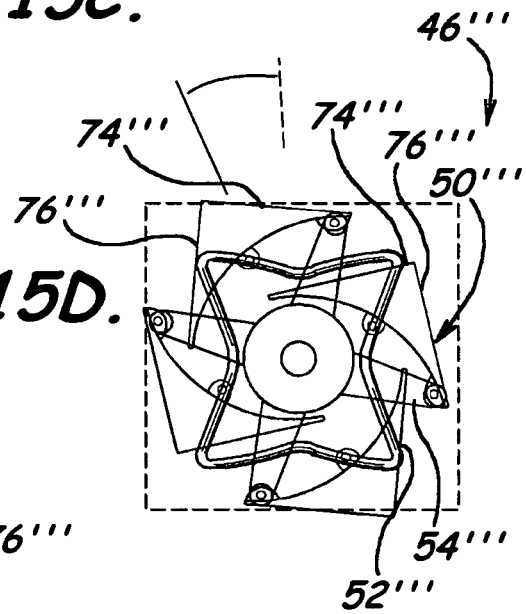
Figure 15E:
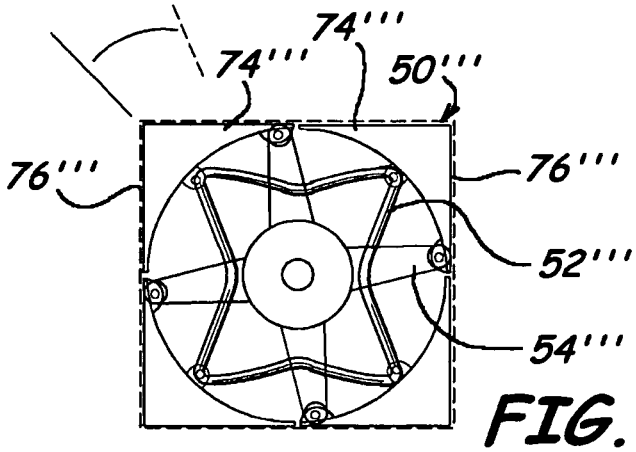

FIGS. 15A–15E illustrate movement of the column member 46''' between a first position, as illustrated in FIG. 15A, and a second position, as illustrated in FIG. 15E. The movement of this embodiment of the column member 46''' is similar to the movement of the first embodiment of the column member 46 illustrated in FIGS. 7A–7E. More particularly, FIGS. 15B–15C illustrate the column member 46''' being moved between the first position and the second position. As illustrated in FIGS. 15B–15D, the display members 50''' pivot inwardly when adjacent the concave side portions 53''' of the display guide 52'''. The other elements of this embodiment of the invention are similar to those of the first embodiment, are labelled with triple prime notation, and require no further discussion herein.

Referring now additionally to FIGS. 18–22, another embodiment of the display system 40'''' is now described in greater detail. This embodiment of the display system 40'''' includes a magnetic drive assembly 80'''' that is carried by the frame (not shown). The magnetic drive assembly 80'''' may engage the column connection members 44'''' to selectively rotate the column members 46''''.

The magnetic drive assembly 80'''' may illustratively include a power source 82'''', and a plurality of energizing members 84'''' connected thereto. The energizing members 84'''' illustratively include a plurality of electromagnets 85''''. Although the energizing members 84'''' of the magnetic drive assembly 80'''' are illustrated with a plurality of electromagnets 85'''', those skilled in the art will appreciate that the energizing members may also be provided with one electromagnet.

The energizing members 84'''' may be provided by energizing disks having a bottom portion 86'''', sidewalls 87'''' extending upwardly from the bottom portion, and a top portion 88'''' overlying the bottom portion and connected to the sidewalls. The electromagnets 85'''' may be positioned adjacent the bottom portion 86'''' of the energizing disks and, more specifically, adjacent the outer periphery thereof. Those skilled in the art will appreciate that, as discussed above, the electromagnets 85'''' may be provided by a single electromagnet positioned adjacent the outer periphery of the bottom portion 86'''' of the energizing disk.

The magnetic drive assembly 80'''' may also include a plurality of column movement members 90'''' connected to the column connection members 44''''. The column movement members 90'''' may be positioned spaced-part from, and overlying, the energizing members 84''''.

The column movement member 90'''' may have a bottom portion 92'''', sidewalls 94'''', and a top portion 96'''' overlying the bottom portion and connected to the sidewalls. The column movement member 90'''' may also comprise a drive member 98'''' having an arcuate shape and positioned adjacent an outer periphery of the bottom portion 92''''. Of course, those skilled in the art will understand that the column movement member 90'''' may include a plurality of drive members 98'''' positioned adjacent the outer periphery of the bottom portion 92'''' thereof. More particularly, the plurality of drive members 98'''' may be provided by four drive members, each having an arcuate shape and spanning slightly less than 90 degrees adjacent the outer periphery of the bottom portion 92'''' of the column movement member 90''''. The four drive members 98'''' are preferably spaced-apart to allow ninety 90 degree rotation of the column members 46''''.

Figure 18:
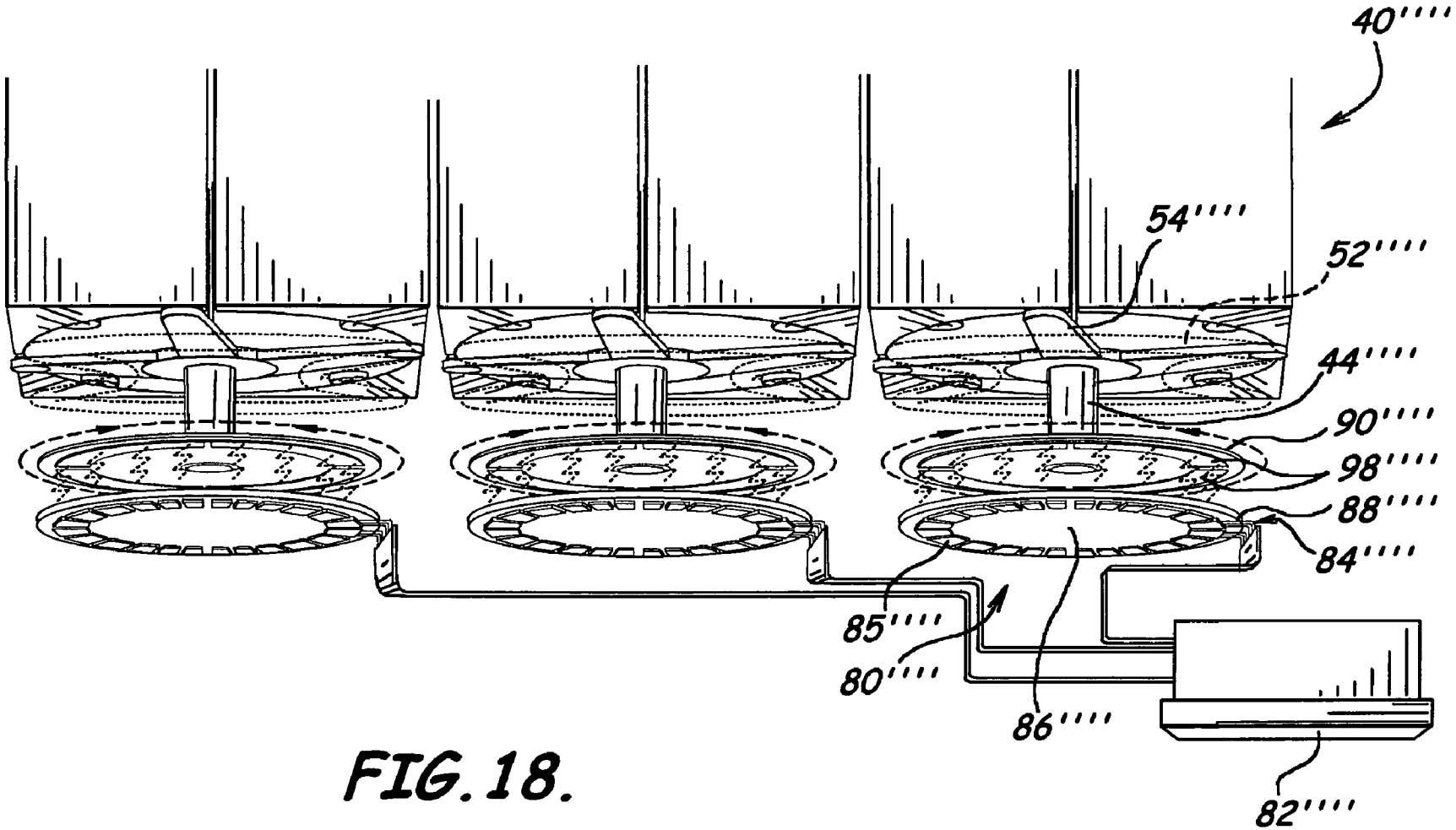
FIG. 18 is a partial perspective view of a plurality of column members engaging a magnetic drive assembly according to the present invention.
Figure 19:
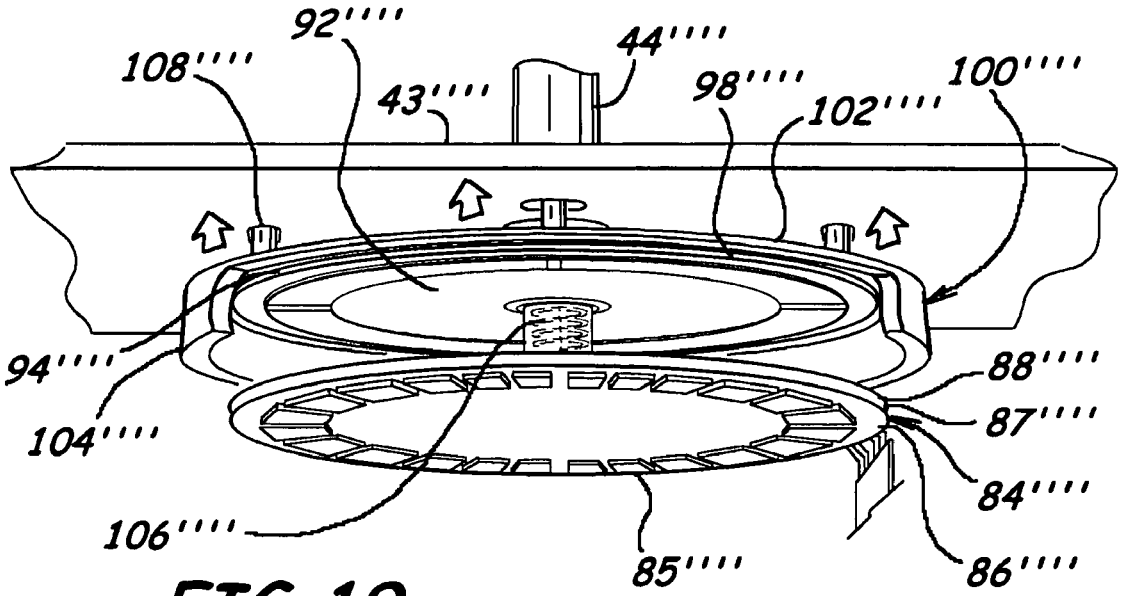
FIG. 19 is a partial perspective view of a magnetic drive assembly according to the present invention in a disengaged lock position.
Figure 20:
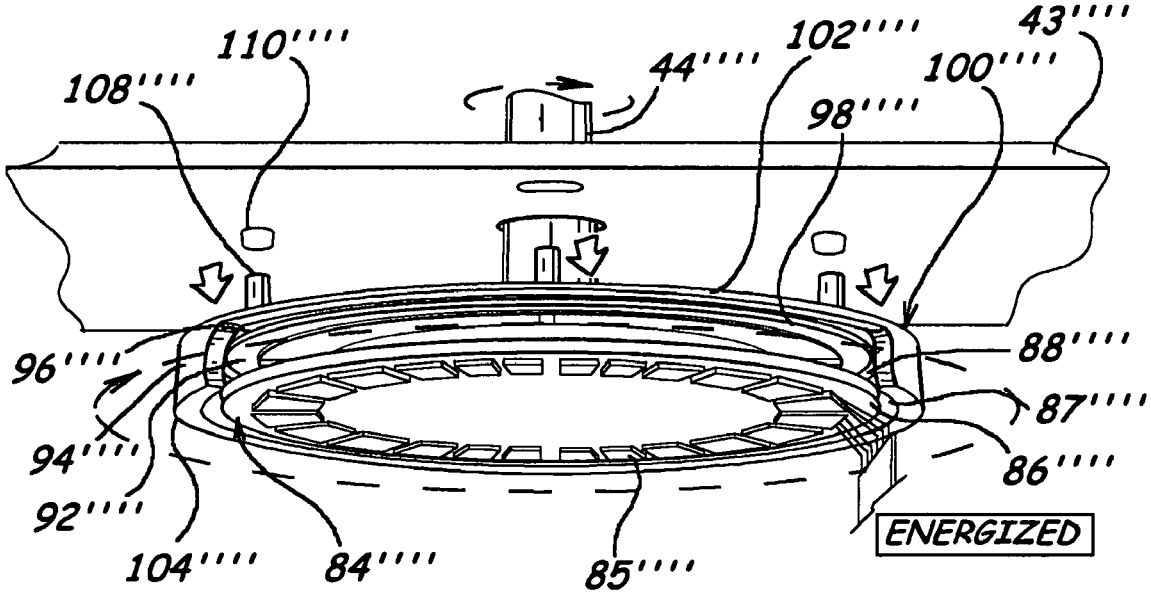
FIG. 20 is a partial perspective view of the magnetic drive assembly illustrated in FIG. 19 in an engaged and unlocked position.

The electromagnet 85'''' of each of the energizing members 84'''' may be selectively energized to form a magnetic field between the energizing members and the column movement members 90''''. The magnetic field preferably causes rotation of the column members 46''''. As illustrated in FIGS. 18–20, and as described in detail above, the energizing members 84'''' may comprise a plurality of electromagnets 85''''. The plurality of electromagnets 85'''' are preferably spaced-apart and in communication with one another. Each of the plurality of electromagnets 85'''' may be individually energized to form a magnetic field between a selective one of the electromagnets and the drive member 98''''.

Selectively and individually energizing the electromagnets 85'''' advantageously provides a moving magnetic field between the electromagnets and the drive member 98'''' of the column movement member 90''''. The moving magnetic field causes rotation of the column connection members 44'''' to which the magnetic drive assembly 80'''' is connected, thereby causing rotation of the column members 46''''.

As perhaps best illustrated in FIGS. 19 and 20, the magnetic drive assembly 80'''' may also include a return cover 100'''' connected to each column movement member 90''''. More particularly, the return cover 100'''' overlies the column movement member 90'''', and includes a top 102'''' and sidewalls 104'''' connected to, and extending downwardly from, the top. The sidewalls 104'''' of the return cover 100'''' overlie the energizing member 84''''. More specifically, the sidewalls 104'''' of the return cover 100'''' overlie the sidewalls 87'''' of the energizing members 84''''. The return cover 100'''' may advantageously prevent trash or other debris from collecting between the energizing member 84'''' and the column movement member 90''''.

The column movement members 90'''' are preferably moveable between an engaged position and a disengaged position. FIG. 19 illustrates the column movement member 90'''' in the engaged position. FIG. 20 illustrates the column movement member 90'''' in the disengaged position.

A spring member 106'''' may be positioned between the energizing member 84'''' and the column movement member 90''''. When the electromagnets 85'''' of the energizing member 84'''' are energized, the column movement member 90'''', and more specifically, the drive member 98'''' connected to the column movement member, are drawn downwardly towards the energizing member.

Accordingly, as the column movement member 90'''' is drawn downwardly towards the energizing member 84'''', the spring member 106'''' is compressed. When power to the electromagnets 85'''' is cut off, the column movement member 90'''' may move back to the engaged position. More specifically, the spring member 106'''' may move from a compressed position to a relaxed position to assist in moving the column movement member 90'''' to the engaged position.

Those skilled in the art will appreciate that the column movement member 90"" may also be moved between the engaged and the disengaged positions using an actuator, for example, or any other mechanism suitable for moving the column movement member between the engaged and disengaged positions.

The return cover 100"" may include a plurality of lock members 108"" connected to the top portion 102"" thereof. The display guide base 43"" may have a plurality of lock member passageways 110"" formed therein. The lock members 108"" may selectively engage the lock member passageways 110"" to prevent rotation of the column members 46"" when the electromagnets 85"" are not energized, i.e., when the column movement member 90"" is in the engaged position.

Four lock member passageways 110"" are preferably formed in the display base 43"". More specifically, the lock member passageways 110"" are preferably positioned along an imaginary circular path formed in the display base 43"". To accommodate the preferred 90 degree rotation of the column members 46"", the lock member passageways 110"" are preferably spaced 90 degrees apart along the imaginary circular path.

Similarly, the lock members 108"" on the top portion 102"" of the return cover 100"" are preferably spaced 90 degrees apart along an imaginary circular path on the top of the return cover. Accordingly, when the column members 46"" are positioned in any one of the first, second, third and fourth positions, the column movement member. 90"" is preferably in the engaged position, as illustrated in FIG. 19. When the column movement member 90"" is in the engaged position, the lock members 108"" engage the lock member passageways 110"" to prevent rotation of the column movement member 90"" which, in turn, prevents rotation of the column members 46"". Similarly, when the electromagnets 85"" are energized, the drive member 98"" of the column movement member 90"" is drawn downwardly, moving the column movement member to the disengaged position. When the column movement member 90"" is in the disengaged position, the lock members 108"" are disengaged from the lock member passageways 110"" allowing rotation of the column movement members which, in turn, allows for rotation of the column members 46"". Although four lock members 108"" and four lock member passageways 110"" are illustrated in FIGS. 19 and 20, those skilled in the art will appreciate that the objects of the present invention may be accomplished using any number of lock members and lock member passageways.

Figure 21:
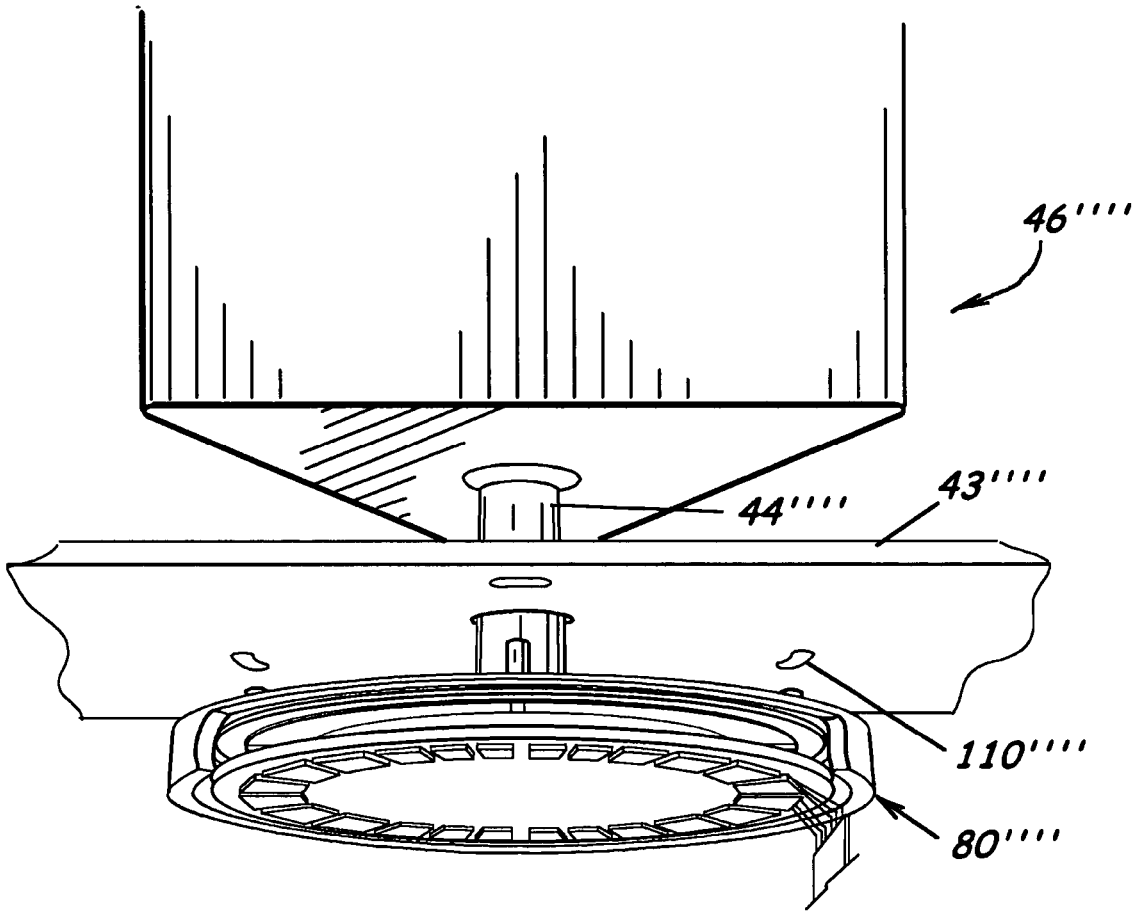
FIG. 21 is a partial perspective view of a magnetic drive assembly of the present invention connected to a column member.

As illustrated in FIG. 21, the magnetic drive assembly 80"" of the present invention may advantageously be used to rotate any type of column member 46"" of any display system 40"". More particularly, and as illustrated in FIG. 21, the magnetic drive assembly 80"" may be used to rotate a three-sided column member 46"". Of course, it is understood that when using the magnetic drive assembly 80"" of the present invention to rotate a three-sided column member 46"", it is appropriate to use three lock members 108"" and three lock member passageways 110"". In such a configuration, the lock members 108"" and the respective lock member passageways 110"" are spaced 120 degrees apart to allow for rotation of the three-sided column members 46"" between three positions.

Those skilled in the art will also appreciate that the magnetic drive assembly 80"" of the present invention may be used to rotate any object. More specifically, the magnetic drive assembly 80"" may be used to rotate platforms suitable for displaying both large and small objects. For example, a rotating jewelry display for rotating an article of jewelry may be rotated using a magnetic drive assembly 80"" of the present invention. Also, for example, a rotating automobile display for rotating an automobile at an automobile show may be rotated using a magnetic drive assembly 80"" of the present invention.

Figure 22:
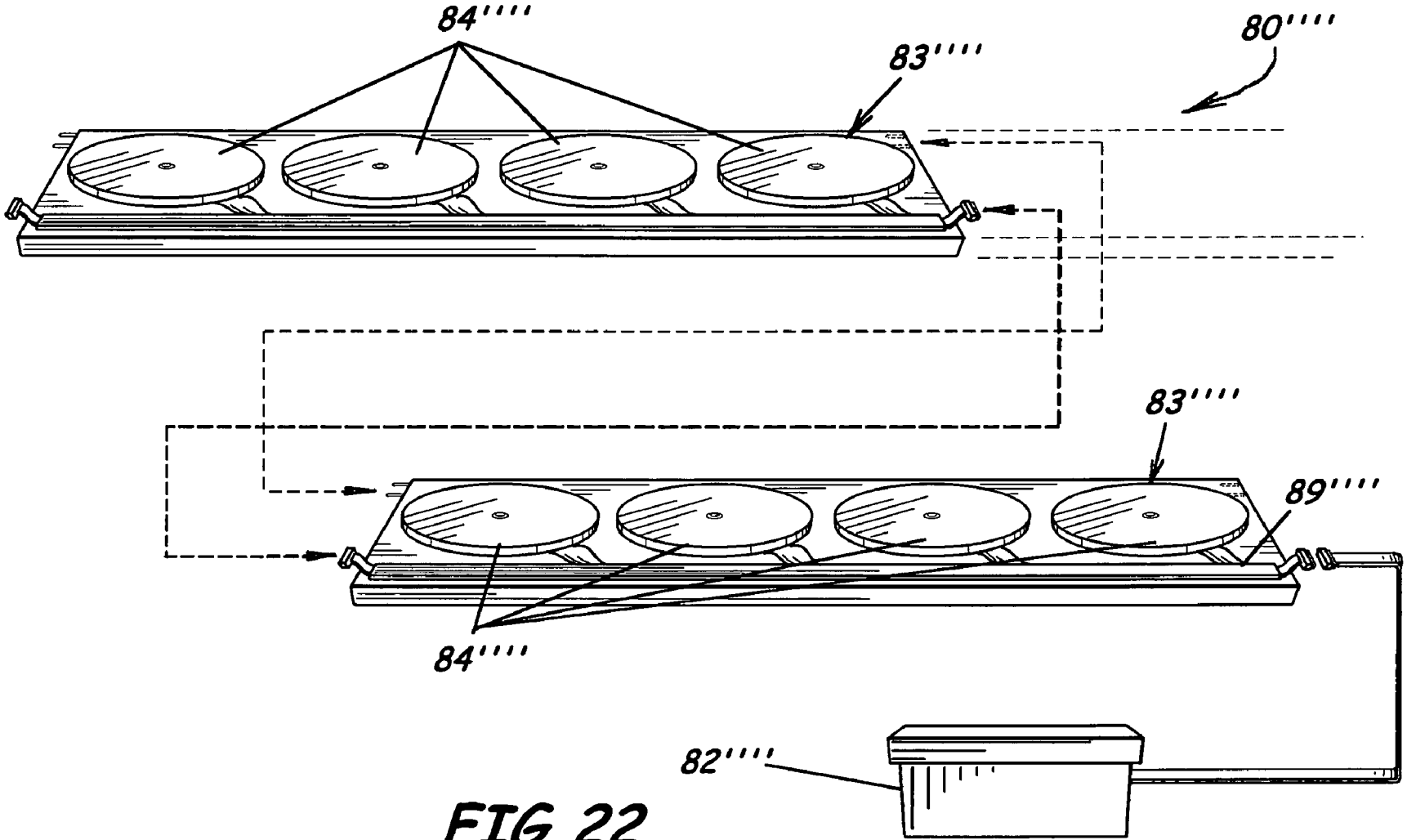
FIG. 22 is a perspective view of a plurality of energizing members of the magnetic drive assembly of the present invention connected in series.

Referring now additionally to FIG. 22, the plurality of energizing members 84"" may be carried by an energizing base 83"". The energizing member base 83"" may have a combined power and data line 89"" positioned to extend the lengthy length thereof. The energizing members 84"" may be connected in series to the power and data line 89"".

The power and data line 89"", of course, is connected to the power source 82"". Accordingly, the energizing members 84"" may be connected to the power source in series. The data portion of the combined power and data line 89"" may transmit programming data to the display system 40"" to define desired rotation of the column members 46"". The other elements of this embodiment of the invention are similar to those of the first embodiment of the invention, are labelled with quadruple prima notation, and require no further discussion herein.

Figure 23:
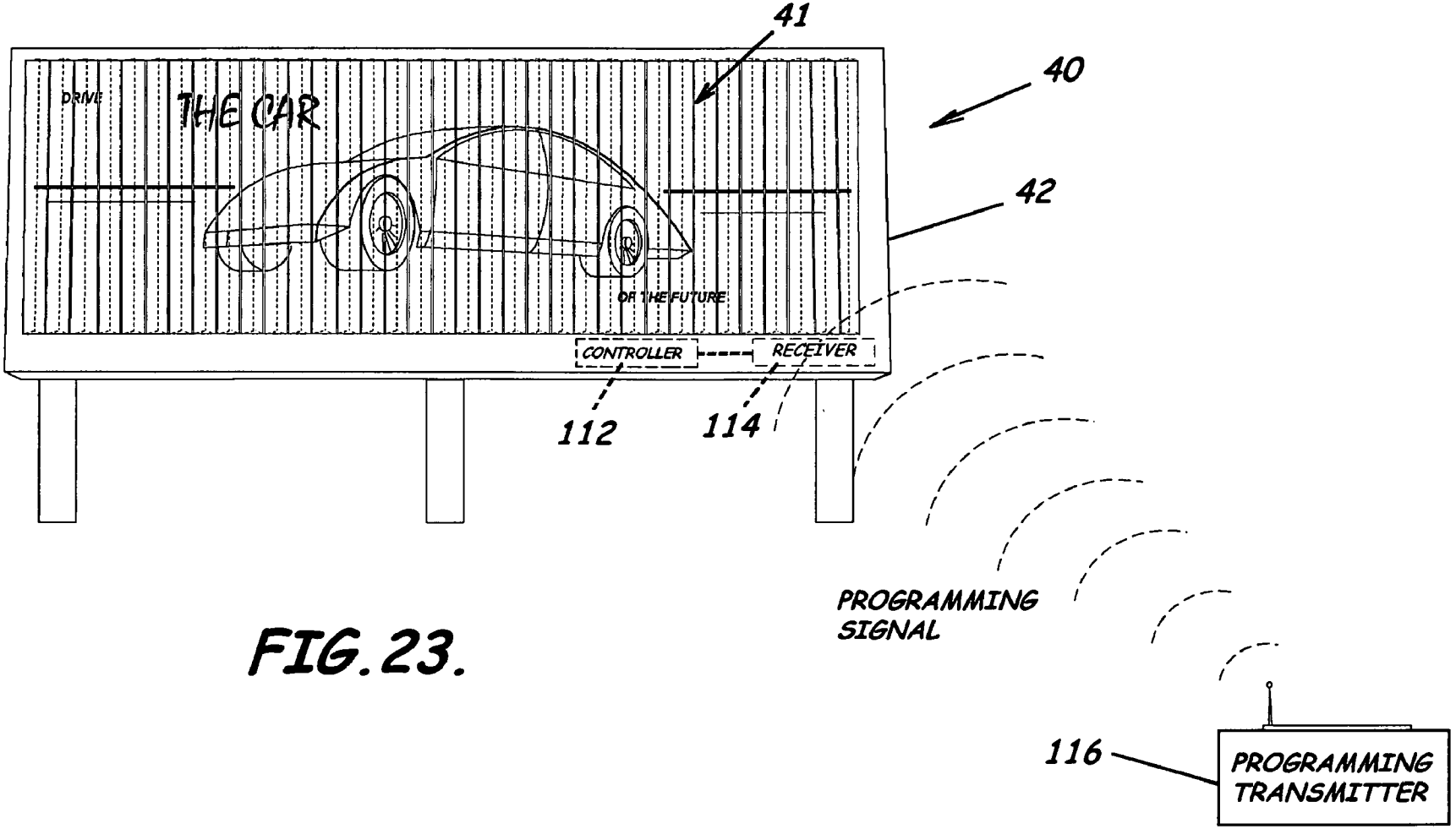
FIG. 23 is an environmental view of the display system receiving a signal from a remote transmitter according to the present invention.

As illustrated in FIG. 23, a controller 112 may be carried by the frame 42. A receiver 114 may also be carried by the frame 42 and in communication with the controller 112. The receiver 114 may receive a predetermined signal to rotate each column member 46 upon receipt of the predetermined signal.

The display system 40 may also include a remote transmitter 116 for transmitting the predetermined signal to the receiver 114. More specifically, the remote transmitter 116 may advantageously be used to control the rotation of the column members 46 from a remote location. This advantageously allows a user to selectively display predetermined sides of the column members from a remote location. The predetermined signal may, for example, be a radio frequency signal, an infrared signal, a hard-wired cable signal, or any other type of signal suitable for controlling rotation of the column members 46 as understood by those skilled in the art.

Figure 24:
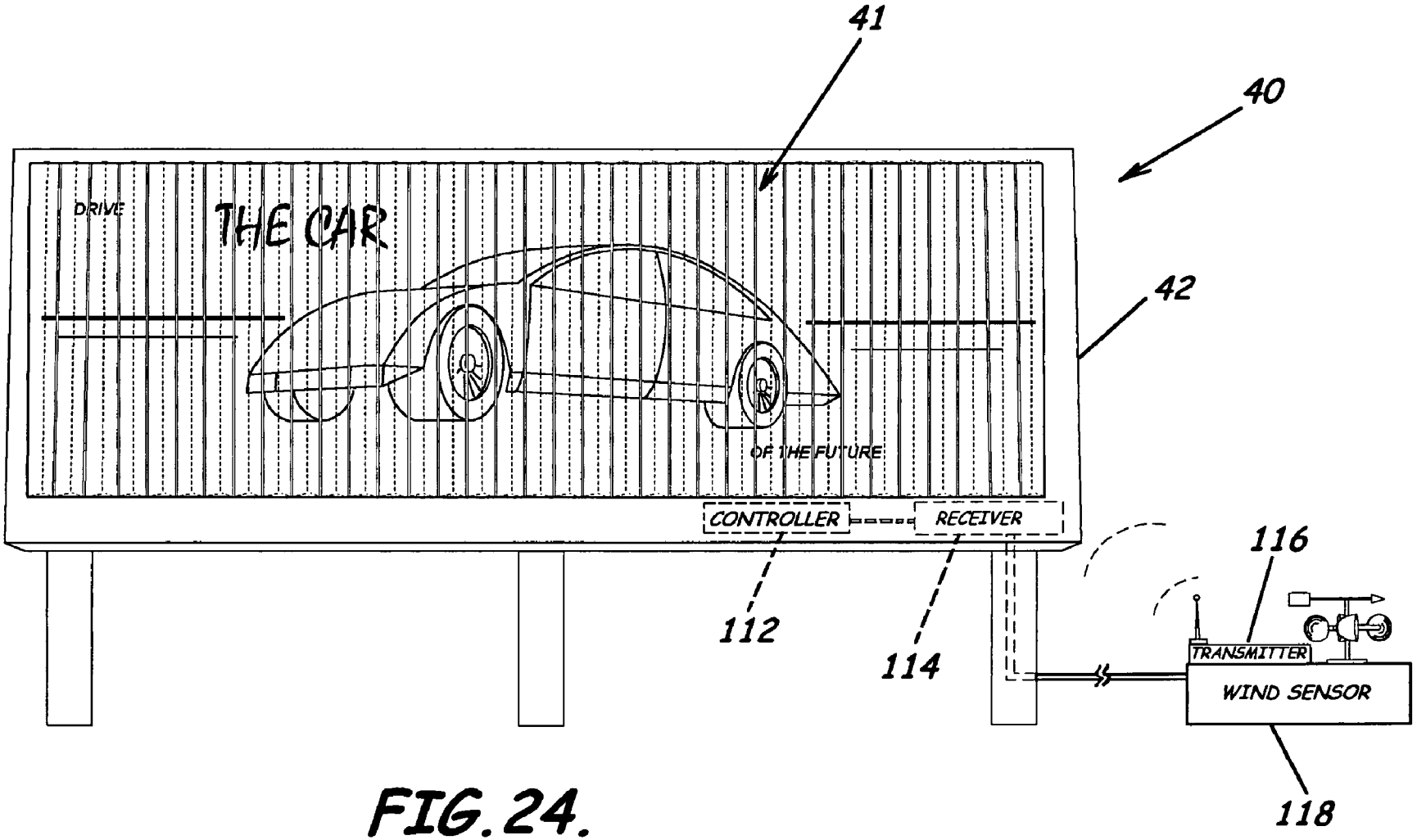
FIG. 24 is an environmental view of a display system in communication with a wind sensor according to the present invention.

As illustrated in FIG. 24, the display system 40 may also comprise a wind sensor 118 positioned adjacent the frame 42. The wind sensor 118 preferably senses wind speed and wind direction. The wind sensor 118 illustrated in FIG. 24 is illustrated adjacent to the frame 42 of the display system 40, but those skilled in the art will appreciate that the wind sensor may also be carried by the frame.

The wind sensor 118 is preferably in communication with the controller 112. Further, the wind sensor 118 may include a remote transmitter 116 for transmitting a predetermined signal to the receiver 114 based on a predetermined wind speed and wind direction sensed by the wind sensor. Accordingly, each column member 46 may be rotated to a position between any one of the first, second, third and fourth positions responsive to the predetermined signal received from the remote transmitter 116 on the wind sensor 118.

More particularly, the wind sensor 118 may rotate the column members 46 to a position similar to those illustrated in FIGS. 7B–7D and 15B–15D to advantageously enhance stability of the display system 40 when encountered with direct winds. The position of the column members 46 illustrated in FIGS. 7B–7D and 15B–15D provides a gap therebetween. Further, a corner of one of the display members 50 may be positioned outwardly, i.e., in a direction facing a direct wind load. Accordingly, when encountered with a predetermined direct wind load, rotation of the column members 46 may be stopped so that a corner of the display members 50 is facing the wind load, thereby displacing the force of the wind load. More specifically, the surface area of the column members 46 may be reduced to allow wind to pass therebetween.

When the wind sensor 118 is used in connection with an embodiment of the invention using the magnetic drive assembly 80"", the column members 46 may be locked into a position between any one of the first, second, third and fourth positions, in response to a predetermined signal received from the wind sensor. More particularly, a plurality of lock member passageways 110"" may be formed in the display base 43"" suitable for engaging the lock members 108"" on the return cover 100"" so that the column members 46 may be stopped in a position between any of the first, second, third and fourth positions.

Figure 26:
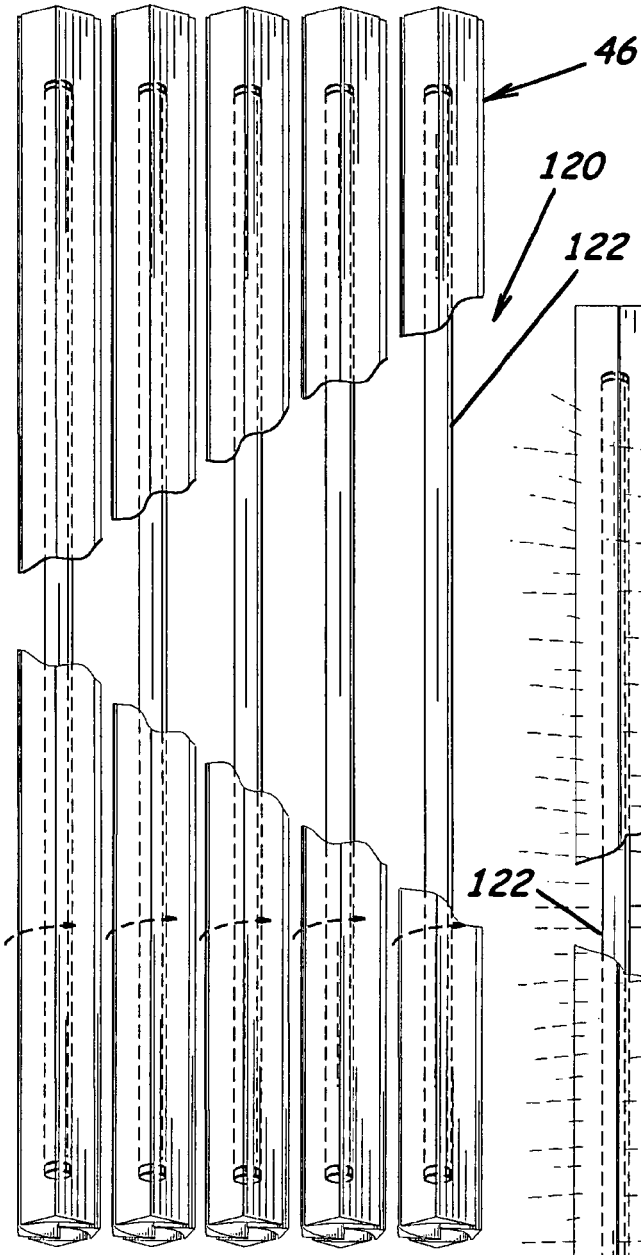
FIG. 26 is a partial perspective view of the plurality of column members shown in FIG. 25 with the illumination source in an on position.
Figure 25:
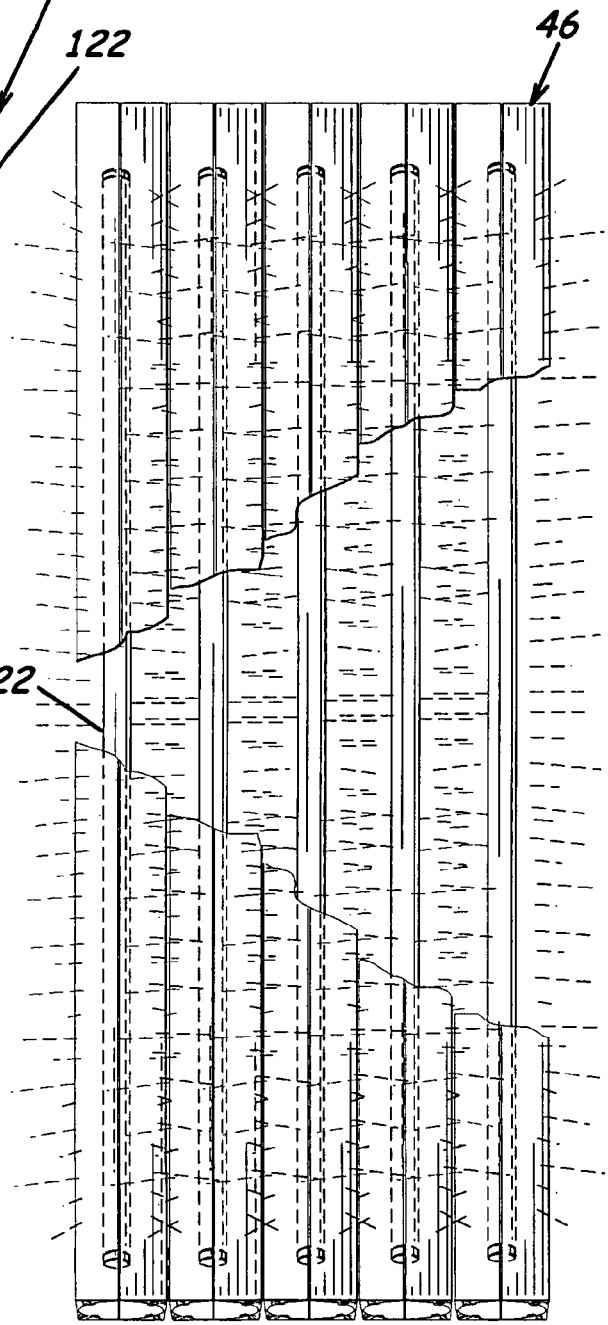
FIG. 25 is a partial perspective view of a plurality of column members of a display system according to the present invention including an illumination source and in an off position.
Figure 27:
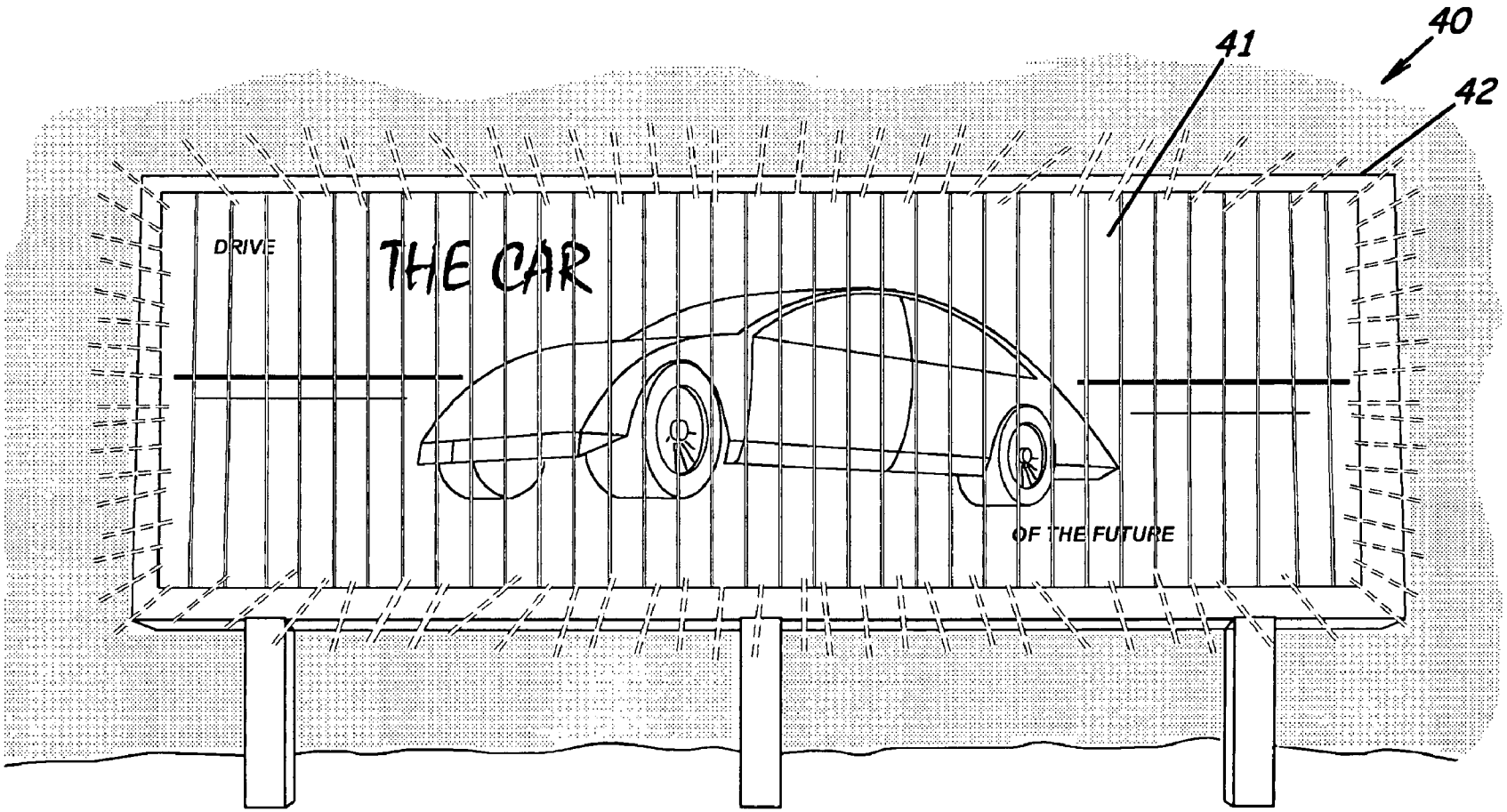
FIG. 27 is an environmental view of an illuminated display system.

Referring now additionally to FIGS. 25–27, another aspect of the display system 40 is now described in greater detail. More specifically, the display system 40 may include an illumination assembly 120. The illumination assembly 120 may include an elongate light source 122 positioned adjacent a medial portion of each column member 46 and connected to a power source. More specifically, the light source 122 may be positioned adjacent the column connection member 44. The light source 122 in FIGS. 25 and 26 is illustrated as elongate lights, such as fluorescent lights, for example. Those skilled in the art, however, will appreciate that any type of illumination source may be provided to illuminate the display system 40.

FIG. 25 shows the column members 46 being moved between any one of the first, second, third and fourth positions, i.e., the display members 50 are pivoting in a predetermined direction to allow for rotation of the column members 46. When the column members are positioned between any one of the first, second, third and fourth positions, the light source 122 is in an off position, so as not to be visible during rotation of the column members 46. When the column members 46 are positioned in any one of the first, second, third and fourth positions, as illustrated in FIG. 26, the light source 122 is illuminated to back light the indicia 99 on the display members 50, as illustrated in FIG. 27.

A method aspect of the present invention is for display indicia 99. The method may include positioning the indicia 99 on the display members 50. More specifically, the indicia 99 may be positioned on the first and second sides 74, 76 of the display members 50. The indicia 99 is preferably advertising indicia, but those skilled in the art will appreciate that the indicia may be any other type of indicia desired to be displayed.

The method may also include rotating the plurality of column members 46 so that the indicia 99 on each of the four-sides of the column members may be selectively displayed. Rotating the plurality of column members 46 may comprise pivoting the display members 50 in a predetermined direction to change the shape of the column members. As discussed in greater detail above, changing the shape of the column members 46 during rotation thereof allows for a plurality of column members positioned adjacent one another to be simultaneously rotated.

Another method aspect of the present invention is for rotating a column member 46"". The method may include selectively energizing an electromagnet 85"" of the energizing member 84"" to form a magnet field between electromagnet of the energizing member and the drive member 98"" of the column movement member 90"" to selectively rotate the column member 46"".

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. A display system comprising:

a frame;

a respective plurality of column connection members connected to said frame;

a respective plurality of four-sided column members positioned adjacent one another and rotatably connected to said respective column connection members, each of said column members comprising a connector including a display guide having an hourglass shape, and a display engagement member overlying the display guide, and a plurality of elongate display members positioned adjacent one another and each pivotally connected to the display engagement member; and a drive assembly carried by said frame and engaging said column connection members to rotate each column member so that selected display members pivot in a predetermined direction during rotation to change the shape of the column members allowing rotation thereof when positioned adjacent one another.

2. A display system according to claim 1 wherein the column members rotate between first, second, third and fourth positions; and wherein the column members rotate ninety degrees to move between the first, second, third and fourth positions.

3. A display system according to claim 1 wherein each connector further comprises a plurality of pin members for connecting each display member to the display engagement member, and for engaging the display engagement member with the display guide.

4. A display system according to claim 1 wherein the hourglass shape of the display guide is defined by convex front and rear portions, and concave side portions.

5. A display system according to claim 4 wherein said plurality of display members comprises pairs of opposing display members; and wherein a first one of the pairs of display members pivots inwardly when adjacent the concave side portions of the display guide as each of the column members rotate.

6. A display system according to claim 1 wherein the display engagement member comprises a first display engagement member positioned adjacent a bottom portion of each column connection member; and further comprising a second display engagement member that engages a top portion of each column connection member.

7. A display system according to claim 1 wherein the display guide is a track, and wherein at least one of the pin members engages the track to pivot the display members in the predetermined direction.

8. A display system according to claim 1 wherein the display guide is a slot formed in a display guide base, and wherein at least one of the pin members engages the slot to pivot the display members in the predetermined direction.

9. A display system according to claim 1 wherein the at least one drive assembly is at least one chain drive assembly.

10. A display system according to claim 9 wherein the at least one chain drive assembly comprises a chain, at least one motor carried by said frame, at least one first chain engaging member connected to the at least one motor for engaging a portion of the chain, at least one second chain engaging member spaced-apart from the at least one first chain engaging member for engaging another portion of the chain, and a drive assembly connection member connected to each respective column connection member to engage the chain so that each column member rotates responsive to movement of the chain.

11. A display system according to claim 1 wherein each of the plurality of display members comprises a base, a first side and a second side positioned adjacent the first side.

12. A display system according to claim 11 wherein the first and second sides of each display member are substantially flat and positioned perpendicular to one another.

13. A display system according to claim 12 wherein the first and second sides of each display member have advertising indicia positioned thereon.

14. A display system comprising:

a frame;

at least one four-sided column member and comprising a display guide having an hourglass shape defined by convex front and rear portions, and concave side portions, a display engagement member overlying the display guide, pairs of opposing elongate display members overlying the display engagement member, and a plurality of pin members for connecting the pairs of opposing display members to the display engagement member, and for engaging the display engagement member with the display guide; and a drive assembly carried by said frame and engaging the at least one column member so that a first one of the pairs of opposing display members pivots inwardly when adjacent the concave side portions of the display guide as the at least one column member rotates.

15. A display system according to claim 14 further comprising at least one column connection member connected to said frame and engaging the display engagement member to connect the at least one column member to said frame; and wherein the display engagement member comprises a first display engagement member positioned adjacent a bottom portion of the at least one column connection member, and a second display engagement member that engages a top portion of the at least one column connection member.

16. A display system according to claim 15 wherein the drive assembly is at least one chain drive assembly comprising a chain, at least one motor carried by said frame, at least one first chain engaging member connected to the at least one motor for engaging a portion of the chain, at least one second chain engaging member spaced-apart from the at least one first chain engaging member for engaging another portion of the chain, and a drive assembly connection member connected to the at least one column connection member to engage the chain so that the at least one column member rotates responsive to movement of the chain.

17. A display system according to claim 14 wherein the display guide is a track, and wherein at least one of the pin members engages the track to pivot the display members.

18. A display system according to claim 14 wherein the display guide is a slot formed in a display guide base, and wherein at least one of the pin members engages the slot to pivot the display members.

19. A method of displaying indicia comprising:

positioning the indicia on a plurality of display members carried by each of a plurality of rotatable four-sided column members connected to a frame and positioned adjacent one another, the plurality of display members each being pivotally connected to a display engagement member that overlies a display guide having an hourglass shape, the indicia being positioned on first and second sides of each display member; and rotating the plurality of column members to selectively display the indicia on each of the four sides of the column members;

wherein rotating the plurality of column members comprises pivoting each of the plurality of display members in a predetermined direction to change the shape of the column members allowing rotation thereof when positioned adjacent one another.

20. A method according to claim 19 wherein each of the column members are connected to a drive assembly; and wherein rotating further comprises activating the drive assembly to rotate the column members.

21. A method according to claim 20 wherein the drive assembly comprises a chain drive assembly including a chain, a motor, a first chain engaging member connected to the motor for engaging a portion of the chain, and a second chain engaging member spaced-apart from the first chain engaging member for engaging another portion of the chain; and further comprising rotating each column member responsive to movement of the chain.

22. A method according to claim 19 wherein a plurality of pin members connect the display members to the display engagement member; and wherein the plurality of pin members engage the display member to the display guide.

23. A method according to claim 22 wherein the display guide is a track; and further comprising engaging at least one of the pin members with the track to pivot the display members.

24. A method according to claim 22 wherein the display guide is a slot formed in a display guide base; and further comprising engaging at least one of the pin members with the slot to pivot the display members.

25. A method according to claim 19 wherein the hourglass shape of the display guide is defined by convex front and rear portions, and concave side portions.

26. A method according to claim 19 wherein the indicia is advertising indicia; and wherein each side of the four-sided column members collectively display an advertisement when aligned adjacent one another.

27. A method according to claim 19 wherein the plurality of display members comprise pairs of display members; and wherein pivoting the plurality of display members comprises pivoting a first one of the pairs of display members inwardly when adjacent the concave side portions of the display guide as each of the column members rotate.

* * * * *